US007316523B1

(12) United States Patent
Allen et al.

(10) Patent No.: US 7,316,523 B1
(45) **Date of Patent: *Jan. 8, 2008**

(54) ACOUSTICALLY MATCHED METHOD AND APPARATUS FOR SCREEDING CONCRETE

(75) Inventors: J. Dewayne Allen, Paragould, AR (US); Richard P. Bishop, Fairfax Station, VA (US)

(73) Assignee: Allen Engineering Corporation, Paragould, AR (US)

( * ) Notice: Subject to any disclaimer, the term of this patent is extended or adjusted under 35 U.S.C. 154(b) by 183 days.

This patent is subject to a terminal disclaimer.

(21) Appl. No.: 11/042,660

(22) Filed: Jan. 25, 2005

Related U.S. Application Data

(63) Continuation-in-part of application No. 10/459,888, filed on Jun. 12, 2003, now Pat. No. 6,857,815.

(60) Provisional application No. 60/389,082, filed on Jun. 14, 2002.

(51) Int. Cl.
*E01C 19/22* (2006.01)

(52) U.S. Cl. ..... 404/114; 404/118

(58) Field of Classification Search ..... 404/75, 404/114, 118, 116

See application file for complete search history.

(56) References Cited

U.S. PATENT DOCUMENTS

| | | | | |
|---|---|---|---|---|
| 3,936,209 | A | | 2/1976 | Krage |
| 3,936,212 | A | | 2/1976 | Holz, Sr. |
| 4,046,484 | A | | 9/1977 | Holz, Sr. |
| D323,510 | S | | 1/1992 | Allen |
| 5,108,220 | A | | 4/1992 | Allen |
| 5,408,258 | A | | 4/1995 | Kolessar |
| 5,480,257 | A | | 1/1996 | Allen |
| 5,520,862 | A | | 5/1996 | Face et al. |
| 5,527,175 | A | | 6/1996 | Face et al. |
| 5,613,801 | A | | 3/1997 | Allen |
| 5,683,767 | A | * | 11/1997 | Shiraki et al. ..... 428/34.9 |
| 5,685,667 | A | | 11/1997 | Allen |
| 5,887,401 | A | * | 3/1999 | Moore, Jr. ..... 52/426 |
| 5,890,833 | A | | 4/1999 | Allen |
| 6,019,545 | A | | 2/2000 | Allen |
| 6,048,130 | A | | 4/2000 | Allen |
| 6,053,660 | A | | 4/2000 | Allen |
| 6,075,310 | A | * | 6/2000 | Bishop ..... 310/328 |
| 6,087,786 | A | | 7/2000 | Allen |
| 6,089,787 | A | | 7/2000 | Allen |
| 6,101,880 | A | | 8/2000 | Face et al. |
| 6,106,193 | A | | 8/2000 | Allen |
| 6,150,752 | A | * | 11/2000 | Bishop ..... 310/328 |
| 6,409,422 | B1 | * | 6/2002 | Mittermaier et al. ..... 404/8 |
| 6,857,815 | B2 | * | 2/2005 | Allen et al. ..... 404/75 |
| 7,059,801 | B2 | * | 6/2006 | Snyder et al. ..... 404/112 |
| 7,104,725 | B1 | * | 9/2006 | Kipp et al. ..... 404/112 |
| 7,108,449 | B1 | * | 9/2006 | Allen et al. ..... 404/75 |
| 7,114,876 | B1 | * | 10/2006 | Allen et al. ..... 404/112 |

* cited by examiner

*Primary Examiner*—Gary S. Hartmann
(74) *Attorney, Agent, or Firm*—Stephen D. Carver

(57) ABSTRACT

Methods and apparatus for screeding freshly placed concrete in which the acoustic impedance of the treating equipment is made substantially equal to the acoustic impedance of the concrete slab. Portions of the screed contacting the plastic concrete are matched to an acoustic impedance approximating the acoustic impedance of plastic concrete, promoting the energy transferred to the concrete. The acoustic matching material is fabricated from a material that has an acoustic impedance within 67% to 150% of the acoustic impedance of the concrete being finished. The acoustic matching material has an abrasion resistance of no greater than 150 measured using ASTM Method G-65 where steel is given a rating of 100. The preferred matching material comprises ultra-high molecular weight polyethylene (UHMWPE) plastic.

6 Claims, 32 Drawing Sheets

ACOUSTICALLY MATCHED METHOD AND APPARATUS FOR SCREEDING CONCRETE

CROSS-REFERENCE TO RELATED APPLICATION

This application is a continuation-in-part of an application entitled "Acoustic Impedance Matched Concrete Finishing", Ser. No. 10/459,888, filed Jun. 12, 2003, now U.S. Pat. No. 6,857,815 issued Feb. 22, 2005, which was in turn based upon a previously filed provisional application, Ser. No. 60/389,082, filed Jun. 14, 2002, which was entitled "Acoustic Impedance Matched Concrete Finishing Equipment."

BACKGROUND OF THE INVENTION

1. Field of the Invention

This invention relates generally to powered, concrete screeding equipment for treating concrete surfaces, including vibrating screeds. More particularly, our invention relates to a system for maximizing the mechanical power inputted to freshly placed concrete by screeding machines.

2. Description of the Prior Art

The prior art includes a vast number of differently-configured screeds and strike-offs comprising elongated spans of metal that directly contact freshly poured concrete. Relatively large and heavy duty triangular truss screeds are also well known. Typical triangular truss screeds ride upon forms, being drawn by cables and winch assemblies. Smaller, simpler screeds, including strike-offs, bull-floats and various floating screeds that are manually pushed and/or pulled by operators, are also well known. Vibration systems, which may comprise various shaft driven arrangements, or multiple, separately-powered units, comprising, for example, pneumatic vibrators, are preferred. Vigorous vibrational forces developed and distributed by finishing screeds help solidify concrete, and, importantly, water is encouraged to migrate to the surface. If vibrational screeding is optimally conducted immediately after a pour, a stronger, more chip-resistant concrete surface will result, thereby minimizing unwanted delamination. Subsequent finishing steps include troweling, which typically commences with the panning of plastic concrete. As the concrete hardens, troweling is concluded with the trowel blades after removing the pans.

U.S. Pat. No. 4,798,494 issued Jan. 17, 1989 to Allen Engineering Corporation discloses a floating, vibrating screed for striking off, float finishing and vibrating plastic concrete without being supported upon forms. A rigid, buoyant pan adapted to float upon and contact the plastic concrete includes a plurality of spaced-apart, pneumatic vibrators that vigorously vibrate the screed.

U.S. Pat. No. 4,046,484, shows a pioneer, twin rotor, self-propelled riding trowel wherein the rotors are tilted to generate steering forces. U.S. Pat. No. 3,936,212, also issued to Holz, shows a three rotor riding trowel powered by a single motor. Although the designs depicted in the above two Holz patents were pioneers in the riding trowel arts, the devices were difficult to steer and control.

Prior U.S. Pat. No. 5,108,220, owned by Allen Engineering Corporation, the same assignee as in this case, relates to an improved, fast steering system for riding trowels. It incorporates a steering system to enhance riding trowel maneuverability and control. The latter fast steering riding trowel is also the subject of U.S. Des. Pat. No. 323,510, owned by Allen Engineering Corporation.

U.S. Pat. No. 5,613,801, issued Mar. 25, 1997, to Allen Engineering Corporation, discloses a power-riding trowel equipped with separate motors for each rotor. Steering is accomplished with structure similar to that depicted in U.S. Pat. No. 5,108,220 previously discussed.

The forces exerted upon concrete by the blades or body of the chosen finishing device are many. For example, frictional forces are developed and experienced by blade contact upon the concrete surface as the trowel rotors, from which they project, forcibly revolve. Compressive forces are applied at the surface by the distributed weight of the finishing apparatus. Most importantly, a variety of forces are applied throughout the partially uncured slab by the trowel.

The amount of energy that is introduced to the concrete from the finishing equipment depends upon the intensity of the applied forces and the amount of energy that is reflected back from the concrete toward the energy source. Various physical properties of the vibrating equipment and of the concrete being finished affect the energy transmission rate and efficiency. Parameters affecting the rate of transmission and reflection of acoustic energy relate to acoustic impedance. When the acoustic impedance of the energy source substantially equals that of the energy destination, the impedances are "matched" and there is no reflection of the acoustic energy away from its destination back toward its source.

The basic method of matching acoustic impedances consists of mechanically joining a source of sound energy—a vibrator or a loudspeaker or some other source—to another object that is to be vibrated such as your eardrum or a microphone. There may in fact be several linked objects in an acoustic power train. In the most general form, there is a source of sound energy (such as a converter of electrical energy to mechanical energy, represented by the voice coil in a loudspeaker) and an absorber of sound energy (such as the load to which sound energy is applied.)

In each stage of the power train, where the form of acoustic energy is altered or where the medium in which the energy travels is changed, there exists an interface through which the energy moves. This discussion assumes that the interface is an abrupt change in nature, but it may actually be a continuous transition having a gradually changing nature. It is the impedance variation at each interface that determines the nature of energy transmission.

The energy at each interface will undergo some combination of transmission (passing through it) and reflection (reflection from it), depending upon the impedance relationship. When sound impinges on an interface where the direction of propagation is at an angle to the interface, the sound may also be bent (refracted), but in this discussion we are only considering cases where the direction of propagation is normal to (perpendicular to) the interface.

The transmission coefficient, the fraction of the energy that is transmitted through the interface, is $$T=(4Z_1*Z_2)/(Z_1+Z_2)^2$$

where $Z_1$ and $Z_2$ are the acoustic impedances before and after the interface. Conservation of energy requires that the sum of the reflected energy and the transmitted energy totals the incident energy; there is no loss within the interface, which is a dimensionless surface rather than a physical object. The reflection coefficient, the fraction of the energy that is reflected from the interface, is 1−T.

It is not readily apparent that the transfer of energy from a concrete finishing tool (screed, float, etc.) to the concrete being finished, involves acoustic processes. It is not enough to say "it makes a noise"—although it does. The noise itself is certainly acoustic in nature. The fundamental factor is that there is a transfer of energy. If there were none, then finishing steps such as vibrational screeding would have no finishing effect and it would have no lasting influence on the concrete.

The frequency distribution of the vibrational energy applied by typical finishing machines of the character described is concentrated within relatively narrow bands of acoustic frequencies. As will be recognized by those with skill in the acoustic arts and/or familiarity with wave transmission theory in physics, the concrete masses being vibrated have a characteristic acoustic impedance. Further, the finishing machinery involved exhibits a characterized acoustic "output impedance." Those with skill in the art of physics will appreciate the fact that, in general, the energy transfer between a given "source" and a given "load" will be optimal when the impedance of the load is approximately the same as the impedance of the source. This general principle finds examples in radio antenna theory, acoustic audio applications, and in kinetics of moving systems. We have postulated and experimentally confirmed that the vibrational energy transferred into a concrete slab by a given finishing machine will be maximized when and if the load impedance that the machine experiences is approximately the same as the machine output impedance.

Stated another way, energy transfer will be maximum when there is a minimal acoustic "standing wave ratio" (i.e., "SWR."), which ideally should approach 1:1. Typically however, with prior art concrete finishing devices known to us, there is an appreciable mismatch between the acoustic load impedance characterizing the concrete slab, and the acoustic output impedance exhibited by the finishing machine. As the realized SWR greatly exceeds 1:1, energy that could otherwise be imparted into the concrete "load" is instead "reflected" back into the machine, unnecessarily shaking its structure and in the case of riding trowels, the machine operator. Since acoustic energy is transferred in the process, it is natural to look at the acoustic impedances of the interfaces. Concrete has characteristic impedance values which change as the concrete changes—sets and cures. Values of impedance for a typical unvibrated concrete as it ages are tabulated below:

TABLE 1

Concrete Impedance At Time After Initial Placement

| Condition: | Fresh | 2 hour | 3 hour | 4 hour | 6 hour | 10 hour | 4 day | Cured |
|---|---|---|---|---|---|---|---|---|
| Impedance: | 2.7 | 2.8 | 2.3 | 4.0 | 6.0 | 8.0 | 10.0 | 12.0 |

One possibility for our method is the use of an impedance matching insert, or transmission plate. Considering the simplified case where energy is assumed to be transmitted into the concrete in a direction normal to the surface being finished, two conditions are required to approach 100% transmission of the energy into the concrete (i.e., an acoustic SWR of 1:1). In general, the required characteristic impedance $Z_o$ of a quarter wave matching section applied between a source impedance, $Z_s$ and a load $Z_R$ is governed by the relationship:

$$Z_o^2=(Z_s^2*Z_R^2).$$

The specific acoustic impedance of the transmission plate is the square root of that of the source and destination layers:

$$\Delta_{II}c_{II}=(\Delta_I c_{II}*\Delta_{III}c_{III})^{1/2}.$$

where Δ is the material density, c is the speed of sound in the material, and $_I$, $_{II}$ and $_{III}$ refer to the source layer, the transmission plate, and the destination layer respectively. Using the physical properties given in the table below, and assuming that the energy source is made of steel, the transmission plate must have an impedance of about $10.8\times 10^6$N-s/m$^3$.

TABLE 2

Selected Acoustic Properties

| Material | Speed of sound (m/sec) | Density (kg/m$^3$) | Acoustic Impedance (Ns/m$^3$ × $10^6$) |
|---|---|---|---|
| fresh concrete | 1000 | 2500 | 2.5 |
| Magnesium | 5800 | 1740 | 10.1 |
| steel | 5900 | 7860 | 46.4 |
| Granite | 3950 | 2750 | 10.9 |

A second condition is thought to be that the thickness of the transmission plate equals one-quarter wavelength of the transmitted sound. Although the vibrational energy extends across a spectral band of frequencies, because of phenomena called "resonance", maximal energy will be concentrated in a relatively dominant frequency. When the frequency of operation is fixed by an active transmitter or by a frequency-selective aspect of the system, design is simple; at other times, a resonant condition may determine the operating frequency. More generally, a combination of circumstances will set a range of frequencies. Testing of the equipment will provide design information. If there are no other frequency-determining factors, selection of a transmission plate thickness will force the system to operate at the condition of maximum transmission power based on the same quarter-wavelength criterion. Then, thickness selection will result in setting a resultant frequency that maximizes transmitted power.

For example, if power is to be provided to a four-inch thickness of concrete then it will be most effective when the frequency of operation corresponds to that thickness representing a quarter-wavelength of the sound energy. Fresh concrete has a sound speed of close to 1000 meters per second, so a quarter wavelength of four inches (0.1 meters) occurs at 2500 Hz. The transmission plate then will have an optimum thickness of:

TABLE 3

Suggested Transmission Plate Thickness

| Material: | Suggested Thickness: |
|---|---|
| Magnesium | 22.8 inches |
| Granite | 15.6 inches |

Neither of these thicknesses are practical for concrete finishing equipment, but they illustrate what is theoretically possible.

It is also possible to match acoustic impedance by fabricating an impedance transmission plate made from two different materials, with each material having an acoustic impedance equal to one of the two terminating impedances. For a steel-to-fresh-concrete transition, one material would require an impedance of 2.5 (perhaps beechwood where it is 2.51) and the other would be made of steel. The two pieces, one made from each material, are simply glued together. The preferred system provides a means wherein the characteristic acoustic impedance of a finishing machine is matched to the acoustic impedance of the concrete load.

Tables 4 and 5 show the resultant transmission coefficients for the tabulated concrete impedances during the setting and curing cycle given on the previous page. The energy transfer characteristics are given for likely screed blade materials and for some possible plastic and wood materials that may have more favorable properties.

TABLE 4

Interface Transmission Coefficient: Common Metals

| Age-hours | Fraction Transmitted MAGNESIUM | ALUMINUM | TITANIUM | BRASS | STEEL |
|---|---|---|---|---|---|
| 1 | 0.68 | 0.48 | 0.34 | 0.24 | 0.21 |
| 2 | 0.69 | 0.49 | 0.35 | 0.25 | 0.22 |
| 3 | 0.71 | 0.50 | 0.36 | 0.26 | 0.23 |
| 4 | 0.57 | 0.39 | 0.27 | 0.19 | 0.17 |
| 5 | 0.73 | 0.53 | 0.38 | 0.27 | 0.24 |
| 6 | 0.81 | 0.61 | 0.45 | 0.33 | 0.29 |
| 7 | 0.89 | 0.70 | 0.53 | 0.39 | 0.35 |
| 8 | 0.94 | 0.76 | 0.60 | 0.45 | 0.41 |
| 9 | 0.97 | 0.82 | 0.65 | 0.50 | 0.46 |
| 10 | 0.99 | 0.86 | 0.71 | 0.55 | 0.50 |

TABLE 5

Interface Transmission Coefficient: Common Plastics & Woods

| Age- | Fraction Transmitted | | | | | plastics | | |
|---|---|---|---|---|---|---|---|---|
| hours | PINE | LDPE | FIR | HDPE | BEECH | UHMW | TEF-LON | PVC |
| 1 | 0.94 | 0.96 | 0.98 | 0.99 | 1.00 | 1.00 | 1.00 | 0.99 |
| 2 | 0.93 | 0.96 | 0.97 | 0.99 | 0.99 | 1.00 | 1.00 | 1.00 |
| 3 | 0.92 | 0.95 | 0.97 | 0.98 | 0.99 | 1.00 | 1.00 | 1.00 |
| 4 | 0.99 | 1.00 | 1.00 | 1.00 | 0.99 | 0.98 | 0.97 | 0.95 |
| 5 | 0.91 | 0.94 | 0.96 | 0.97 | 0.98 | 0.99 | 1.00 | 1.00 |
| 6 | 0.84 | 0.87 | 0.90 | 0.93 | 0.95 | 0.96 | 0.98 | 0.99 |
| 7 | 0.76 | 0.80 | 0.83 | 0.86 | 0.89 | 0.91 | 0.94 | 0.96 |
| 8 | 0.69 | 0.73 | 0.77 | 0.80 | 0.83 | 0.86 | 0.89 | 0.92 |
| 9 | 0.63 | 0.67 | 0.71 | 0.74 | 0.78 | 0.80 | 0.84 | 0.87 |
| 10 | 0.58 | 0.62 | 0.66 | 0.69 | 0.73 | 0.75 | 0.79 | 0.83 |

When mechanical energy is generated at the interface between the vibration source and the concrete surface, it can be transmitted into the body of the concrete to the degree that the transmission coefficient (T) permits. As seen above, several materials have T quite close to 1 while the concrete is fairly fluid; in this case, up to about four hours after the pour. Specifically, HDPE (high-density polyethylene), beech wood and UHMW (ultra-high molecular weight polyethylene) have excellent transmission of acoustic energy into concrete up to the point where transfer of water and fines from the concrete interior is complete. These materials, especially UHMW since it has adequate abrasion resistance, will make excellent screed or strike-off matching systems. Under slurry-abrasion tests, UHMW is five times more abrasion resistant than steel; performance under troweling conditions has been proven substantially similar.

When concrete has hardened and water and fines have been adequately removed, the impedance of the concrete increases to the point where the transmission coefficient is too low. The energy applied to the concrete interface is no longer absorbed into the body of the concrete. It is not completely clear what the actual mechanism is, and where the acoustic energy goes, but it seems likely that it is trapped at the interface and that most of the energy is converted to heat. The observed results on the concrete surface-hardening, sealing the surface, and development of an impermeable shiny coating, is consistent with what might be expected from interfacial heating and friction.

Magnesium exhibits favorable characteristics. From 75% to almost 100% of the interfacial energy is passed into the concrete with this metal. In comparison, steel only permits 25% to 50% of the energy to pass into the concrete-a good explanation of why steel causes sealing of the concrete surface and the entrapment of water inside it. However, magnesium is not as advantageous for optimizing acoustic energy transfer as wood or plastic.

SUMMARY OF THE INVENTION

The present invention enhances concrete screeding processes by adjusting the nature and intensity of the forces applied to the concrete that effect quality and performance. Through the methods and apparatus disclosed herein, concrete surfaces of superior characteristics are obtained. More specifically, the common industry problem of delamination is minimized.

According to our invention, it is recognized that the freshly placed concrete exhibits an approximate characteristic acoustic impedance range. The characteristic acoustic impedance of the screeding equipment is "optimized" with respect to the acoustic impedance of the concrete slab being treated. In other words, we have determined that the effective acoustic impedance of the screeding equipment be matched with the acoustic impedance of the concrete. Thus, the characteristic acoustic impedance of the screed hardware should be approximately the same as the impedance of the plastic concrete being treated.

Preferably, portions of the screed that contact raw concrete are provided with a layer of acoustic matching material. The result is a characteristic acoustic impedance approximating the acoustic impedance of plastic concrete. With the impedances approximately matched as aforesaid, energy transfer from the screeding machine to the slab being treated is maximized. The process of maximizing the energy transfer encourages high quality finishing, and minimizes the finishing time required. Through the disclosed methods, a highly stable concrete surface results, and delamination is minimized.

While the finishing equipment must be impedance matched, mechanical durability and wear characteristics must be considered as well. The preferred matching material comprises ultra-high molecular weight polyethylene (UHMWPE) plastic, which provides durability and suitable frictional characteristics.

Thus a basic object of our invention is to increase the efficiency of concrete screeding methods and apparatus.

Another basic object is to provide a system for power concrete finishing devices that delivers an enhanced amount of energy to the concrete.

Another basic object is to optimize the power transferred into concrete by powered screeds.

A related fundamental object is to match the acoustic impedance of concrete finishing machines to that of the concrete being finished.

More particularly, it is an important object to match the acoustic impedance of screeds to the acoustic impedance of plastic concrete.

A basic object is to improve the quality of treated concrete structures.

Similarly, it is an important object to minimize delamination.

Another simple object is to efficiently couple vibrational energy generated by vibrating screeds to the concrete load or mass undergoing treatment.

A more specific object is to substantially match the characteristic acoustic impedance of the concrete masses being treated to the characteristic output impedance of the finishing screed.

A related object is to adapt concrete screeding machines such that they output energy into a favorable acoustic impedance standing wave ratio.

Another basic object is to provide a system capable of matching acoustic impedance that is suitable for use with conventional screeds.

A further object is to provide an acoustic impedance transformation system of the character described that is readily compatible with conventional screeds.

Another object is to provide a system of the character described that may be easily retrofitted to existing screeds without substantial mechanical alterations.

Another object is to improve the process of screeding.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and are to be construed in conjunction therewith, in which like reference numerals have been employed throughout in the various views wherever possible, and in which the suffix "A" had been added in the case of similar views showing similar alternative embodiments.

DETAILED DESCRIPTION

Figure 1:
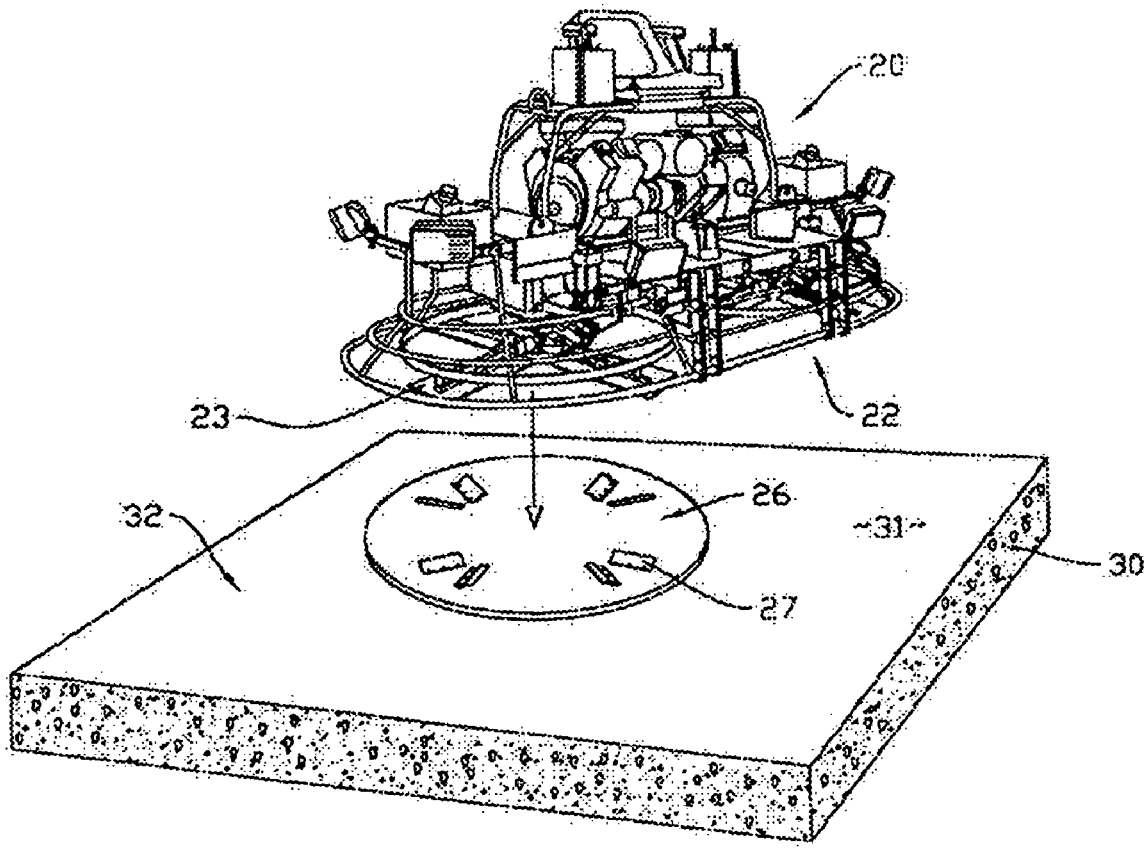
FIG. 1 is a partially exploded, fragmentary isometric and diagrammatic view generally illustrating a preferred method.

With initial reference directed now to FIGS. 1-6 of the appended drawings, a typical power riding trowel 20 comprises a pair of downwardly projecting rotors 22, each of which can receive a conventional steel finishing pan 21 (FIG. 5) for plastic concrete, as is known in the art. However, pan 26 (FIGS. 1, 6) is constructed of materials whose acoustic impedance approximates that of the plastic concrete 30 comprising slab 32 (FIG. 1). Finishing pans 21, 26 have conventional brackets 27 adapted to be coupled directly to the rotor blades 23 in the operation of treating plastic concrete. During the initial stages of troweling, when pans are used, they frictionally contact the concrete surface 31 (FIG. 1); however, after the slab 32 hardens, the pans are removed and blades 23 directly polish the surface 31, generating a hard, impact-resistant outer surface.

Structural details of pertinent riding trowels illustrating basic structural concepts are set forth in detail in prior U.S. Pat. Nos. 5,108,220, 5,613,801, 5,480,257, 5,685,667, 5,890,833, 6,019,545, 6,048,130, 6,053,660, 6,089,786, 6,089,787, and 6,106,193, which, for disclosure purposes, are hereby incorporated by reference herein. The new concepts of this invention may be used with trowels from various manufacturers of different configurations and sizes.

Figure 2:
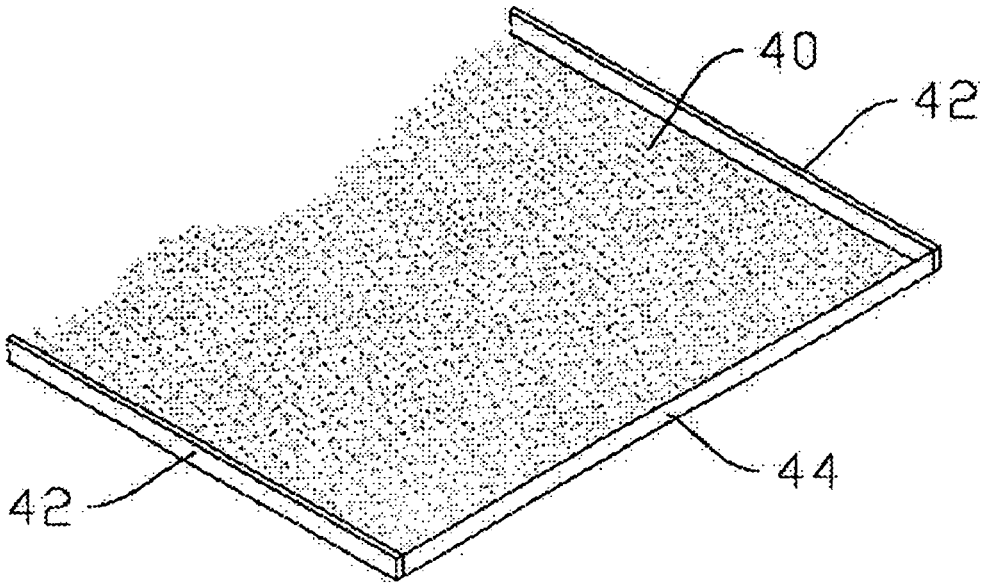
FIG. 2 is a fragmentary isometric view of a typical construction sub grade upon which concrete is to be poured.
Figure 3:
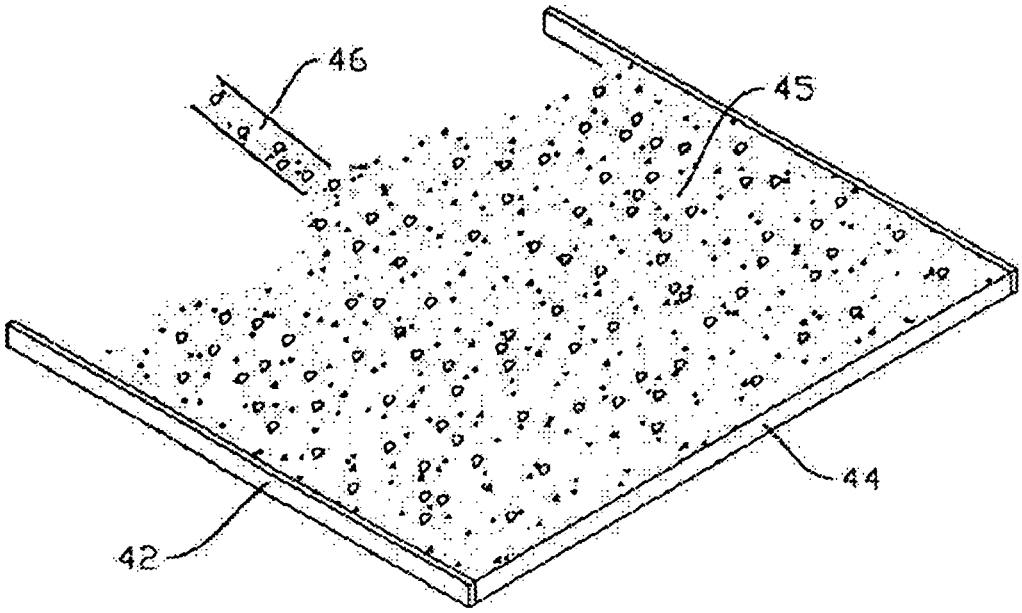
FIG. 3 is a fragmentary isometric view similar to FIG. 2, showing the preliminary placement of raw concrete upon the sub grade.
Figure 4:
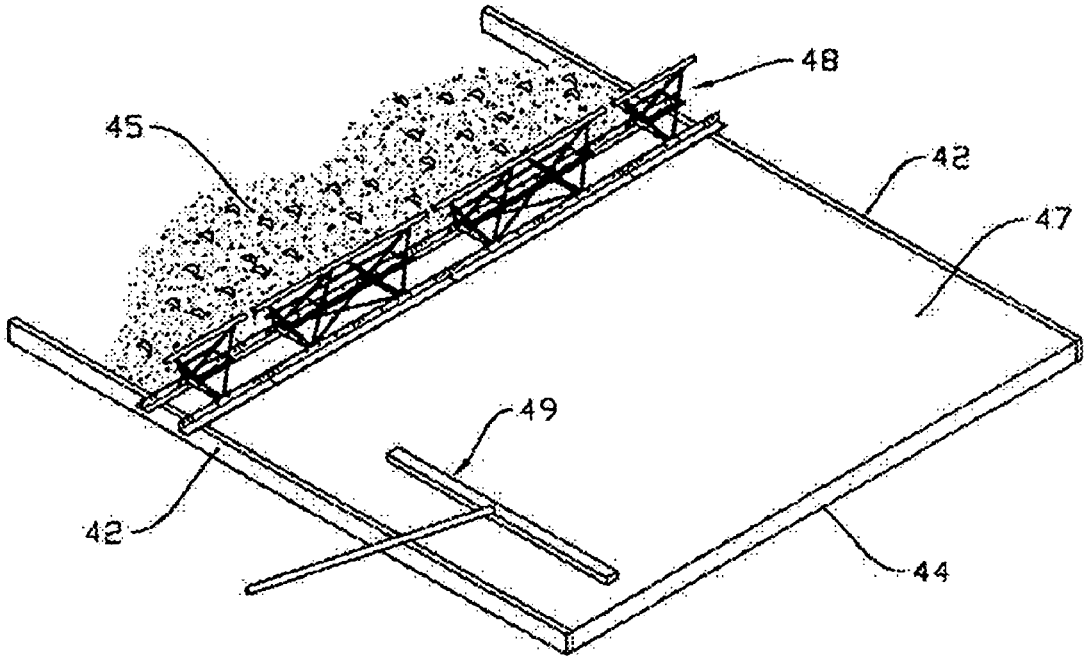
FIG. 4 is a fragmentary isometric view similar to FIGS. 2 and 3, illustrating a strike-off and screeding operation, showing a bull float and a triangular truss screed.
Figure 5:
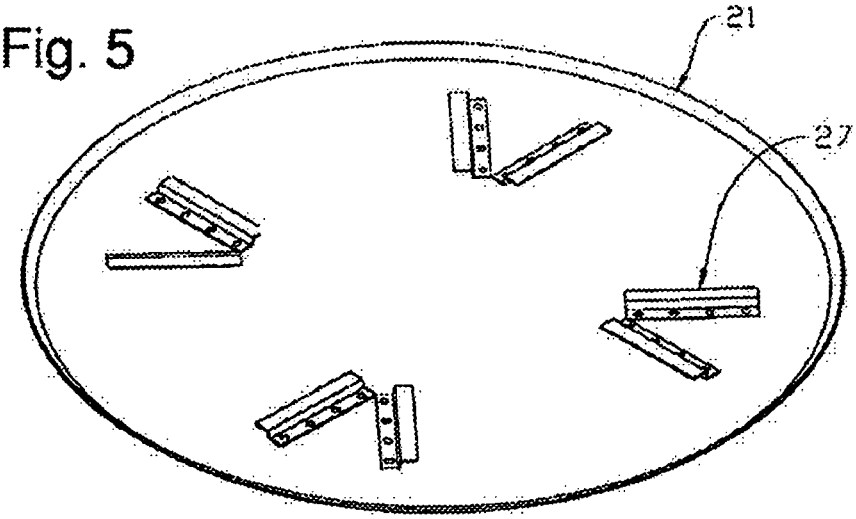
FIG. 5 is a top isometric view of a conventional steel-finishing pan adapted to be coupled to the blades of a conventional riding trowel rotor.

As recognized by those with skill in the art, a selection and preparation of a suitable subgrade 40 (FIGS. 2, 3) precedes the normal placement process. Appropriate forms 42 may confine the subgrade, and one or more transverse headers 44 are typical. The triangular truss screed to be discussed hereinafter may ride upon forms 42. Raw concrete 45 discharged from the delivery truck chute 46 (FIG. 3) will spread throughout the slab area defined between forms 42 and headers 44 (FIGS. 2, 3). Normally the rough concrete 45 will be hand-manipulated by the crew members and distributed evenly between the forms. The vibrating triangular truss screed 48 suspended upon and between forms 42 moves towards the left (i.e., as viewed in FIG. 4), thereby striking off the rough concrete 45, and yielding the flattened slab region 47 (FIG. 4). At this point it is common to treat any remaining surface mars, bumps or irregularities with suitable hand tools such as a bull float 49. Shortly after screeding the slab, it will have sufficient strength to support the weight of the trowel 20. Panning starts the process while the concrete is still plastic. Once the concrete sufficiently hardens, the pans are removed and the rotor blades directly polish the surface.

Figure 6:
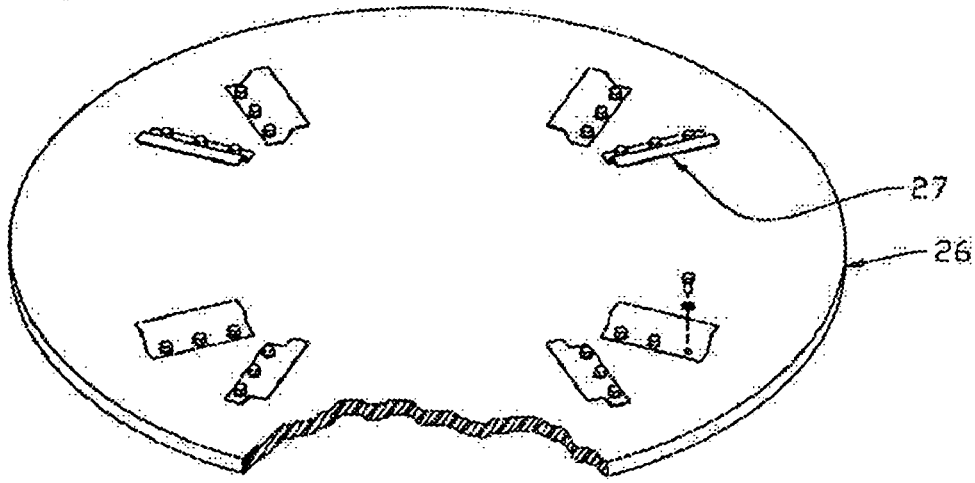
FIG. 6 is a partially, fragmentary, top isometric view of a finishing pan constructed in accordance with the best mode of the invention.

In FIG. 6 the improved pan 26 is seen to be generally circular like conventional steel pan 21. Preferred pans comprise ultra-high molecular weight polyethylene (UHMWPE) plastic, as represented in cross section in FIG. 6. When the pan is mounted, brackets 27 contact the rotor blades 23, which rest upon the upper surface 36 of pan 26 (FIG. 6). Preferred pans comprise ultra-high molecular weight polyethylene (UHMWPE) plastic, as represented in cross section in FIG. 6. When the pan is mounted, brackets 27 contact the rotor blades 23, which rest upon the upper surface 36 of pan 26 (FIG. 6).

Figure 7:
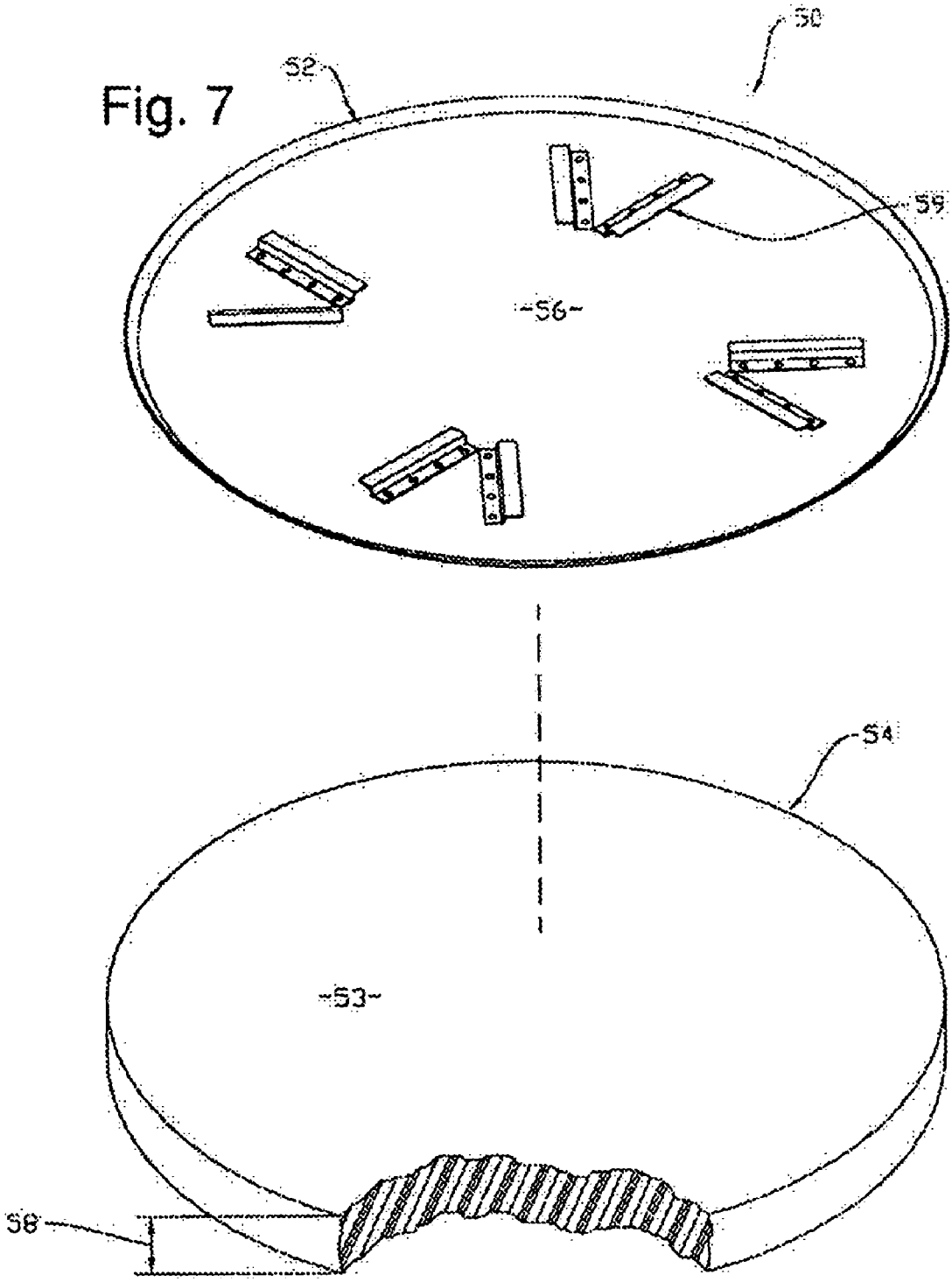
FIG. 7 is an exploded, partially, fragmentary, isometric view of an alternative finishing pan.

FIG. 7 reveals an alternative pan arrangement, generally designated by the reference numeral 50. In this instance, a preferably metallic subframe 52 resembling a conventional steel pan 21 as discussed earlier is used to support a lower impedance matching layer 54. Layer 54 is coaxially and rigidly beneath subframe 52, i.e., underside of subframe 52 is flatly secured to the upper surface 53 of layer 54. The interior surface 56 of subframe 52 is directly contacted by the rotor blades 23 as before, which contact brackets 59. The thickness of the impedance matching layer 54, designated by arrow 58 (FIG. 7) approximates a quarter wavelength (i.e., at the speed of sound in the medium) at the frequency of interest. Preferably, the layer 54 may comprise UHMWPE plastic as before.

In a preliminary test, pans made in accordance with FIG. 6 were mounted upon riding trowels similar to trowel 20 (FIG. 1) described earlier. A subgrade was prepared, forms erected, and concrete was applied. Three separate slabs resembling the aforedescribed arrangement were prepared, using different concrete air percentages. Pan impedance is ideally between 67% to 150% of the impedance of the plastic concrete.

TABLE 6

| | Treated Slab Parameters | | | | | | |
|---|---|---|---|---|---|---|---|
| Slab No. | Slump (in) | Air (%) | Unit Wt. (pfc) | Ambient Temp. | Concrete Temp. | Cylinders Per Set | Time Cast |
| Act-1 | 4.25 | 6.5 | NT | 80 | 84 | 3 | 9:00 am |
| Act-2 | 3.00 | 5.5 | NT | 87 | 87 | 3 | 1:45 pm |
| Act-3 | 4.75 | 3.5 | NT | 88 | 87 | 2 | 2:45 pm |

After placement and vibrational screeding, spectrum analysis of the sound frequencies within each slab were observed and processed during panning, both with steel pans and our new pan. To study and evaluate the effect of matching the acoustic impedance of concrete finishing equipment on the performance of the finishing process, measurements of the energy of vibration induced in the concrete slab, as a function of frequency, were made for equipment having different values of acoustic impedance. The experimental setup included the following: Vibration sensors (for ambient sound level in air in the vicinity of the tested equipment); Don Bosco Electronics, Inc. SA-116 Dynamic Microphone Probe (for vibration induced into the concrete slab); Don Bosco Electronics, Inc. SA-112 Vibration Pickup; *Frequency Spectrum Analyzer*; Hewlett-Packard HP3561A Signal Analyzer.

The sensors were attached to the spectrum analyzer using 75 feet of RG-59A coaxial cable attached using BNC connectors. Frequency spectra were collected by photographing the HP3561A CRT screen using a Kodak 211 digital camera. All of the sample spectra have a vertical axis representing acoustic energy in units of dB(v), with scale values of −131 dB(v) minimum to −41 dB(v) maximum. The horizontal axis of the spectra represents frequency, ranging from 10 Hz to 10,010 Hz, logarithmically scaled.

For in-air spectra the microphone was positioned approximately six feet away from the operating trowel. For in-concrete spectra the vibration sensor probe was inserted vertically into the concrete to a maximum depth of 1.25 inches. The trowel was positioned so that the edge of the rotating pans was about six inches away from the axis of the probe.

Figure 8:
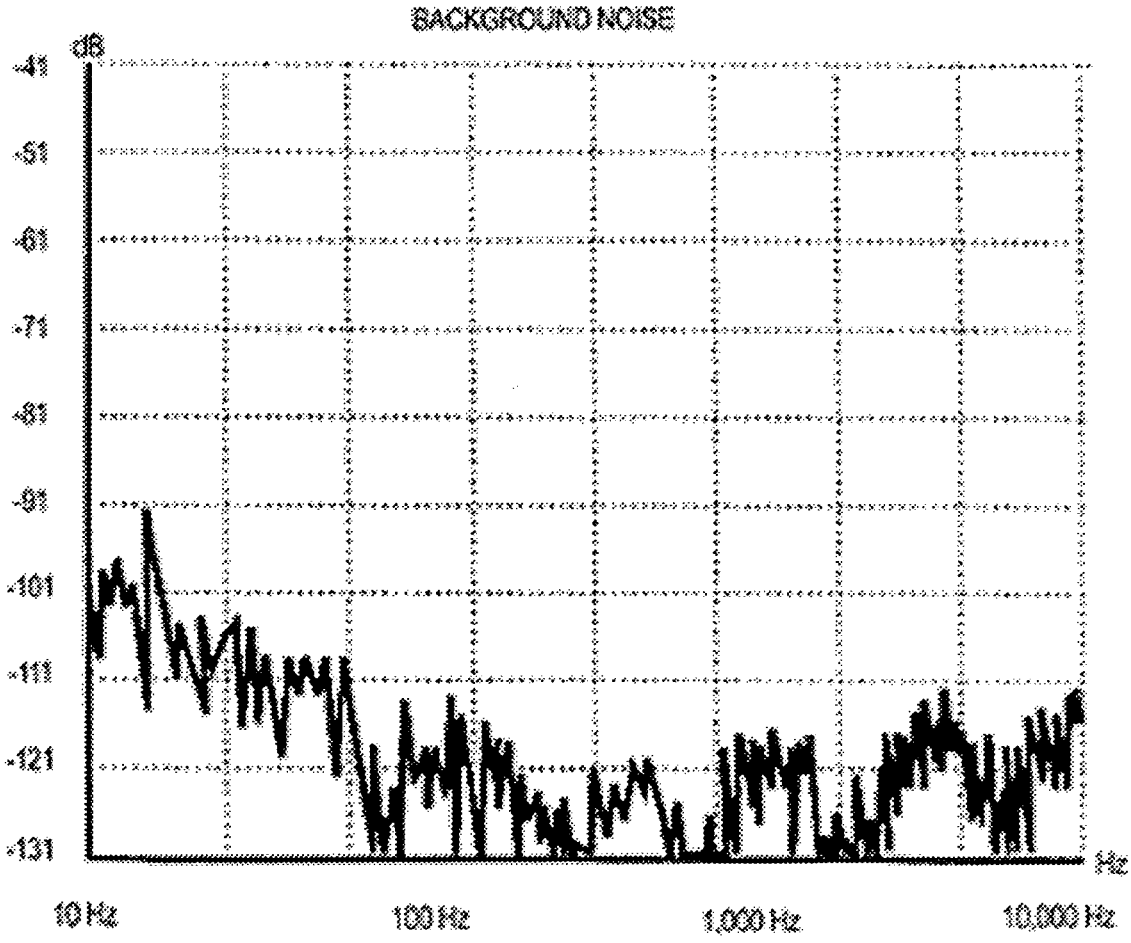
FIG. 8 is a semi-logarithmic graph plotting observed acoustic frequencies against intensity, in which noise from an idling trowel has been measured and plotted.

Typical frequency spectra are included. FIG. 8 depicts the ambient background noise in the vicinity of the operating "rider trowel." The region of significant energy level lies below 50 Hz, with intensity less than −90 dB(v). Above a frequency of 50 Hz, the energy level remains less than −115 dB(v).

Figure 9:
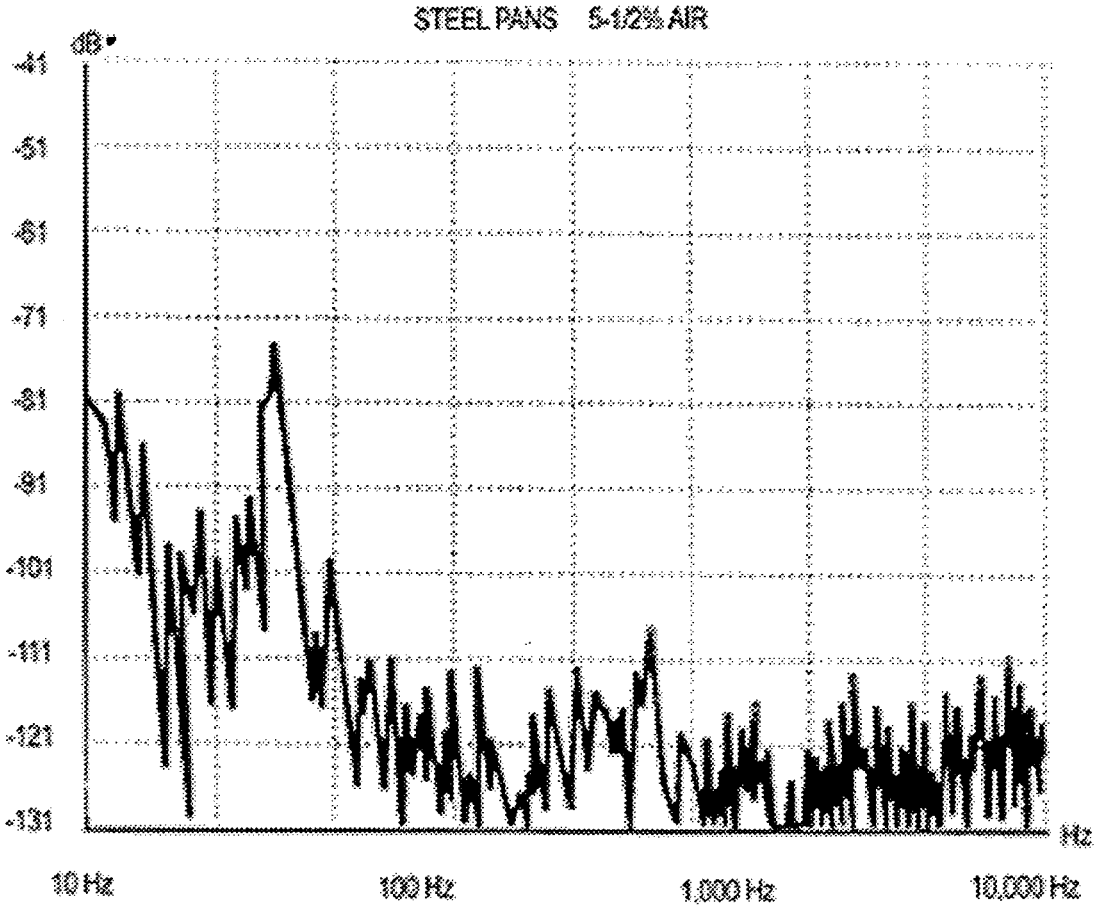
FIG. 9 is a graph similar to FIG. 8 showing observed acoustic energy in a slab with 5.5% air entrainment that is being troweled with conventional steel pans.

FIG. 9 depicts measurements from a trowel having a steel pan, operating over air-entrained concrete. There is significant energy at frequencies below sixty Hz. where the vibration intensity varied between −90 to −75 dB(v). The maximum intensity occurred at about fifty Hz.

Figure 10:
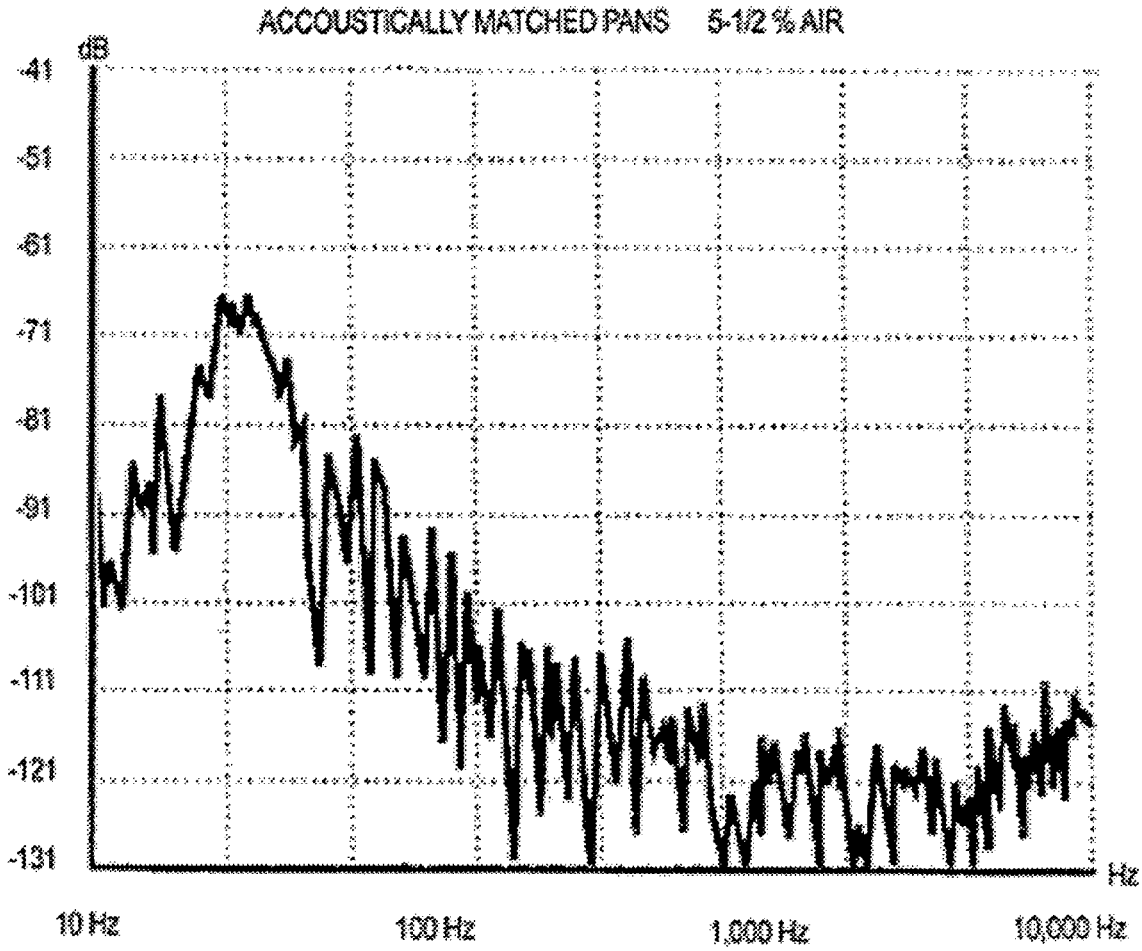
FIG. 10 is a graph similar to FIGS. 8 and 9 showing observed acoustic energy in a slab with 5.5% air entrainment being troweled with acoustically-matched pans.

FIG. 10 similarly shows measurements from an impedance-matched trowel pan (in this case fabricated from UHMW-PE), also operating over air-entrained concrete. The frequency spectrum is broader, having significant intensities at frequencies up to 120 Hz with a maximum intensity at about 40 Hz. The vibration intensity was higher, having a maximum value of −67 dB(v). This intensity is, on a linear scale, about six times that of the maximum measured for the steel pan. The combination of a higher intensity and a broader frequency spectrum demonstrates that there is much more energy transmitted from the rotating pans to the concrete slab when the acoustic impedance of the pans matches that of the concrete.

Figure 11:
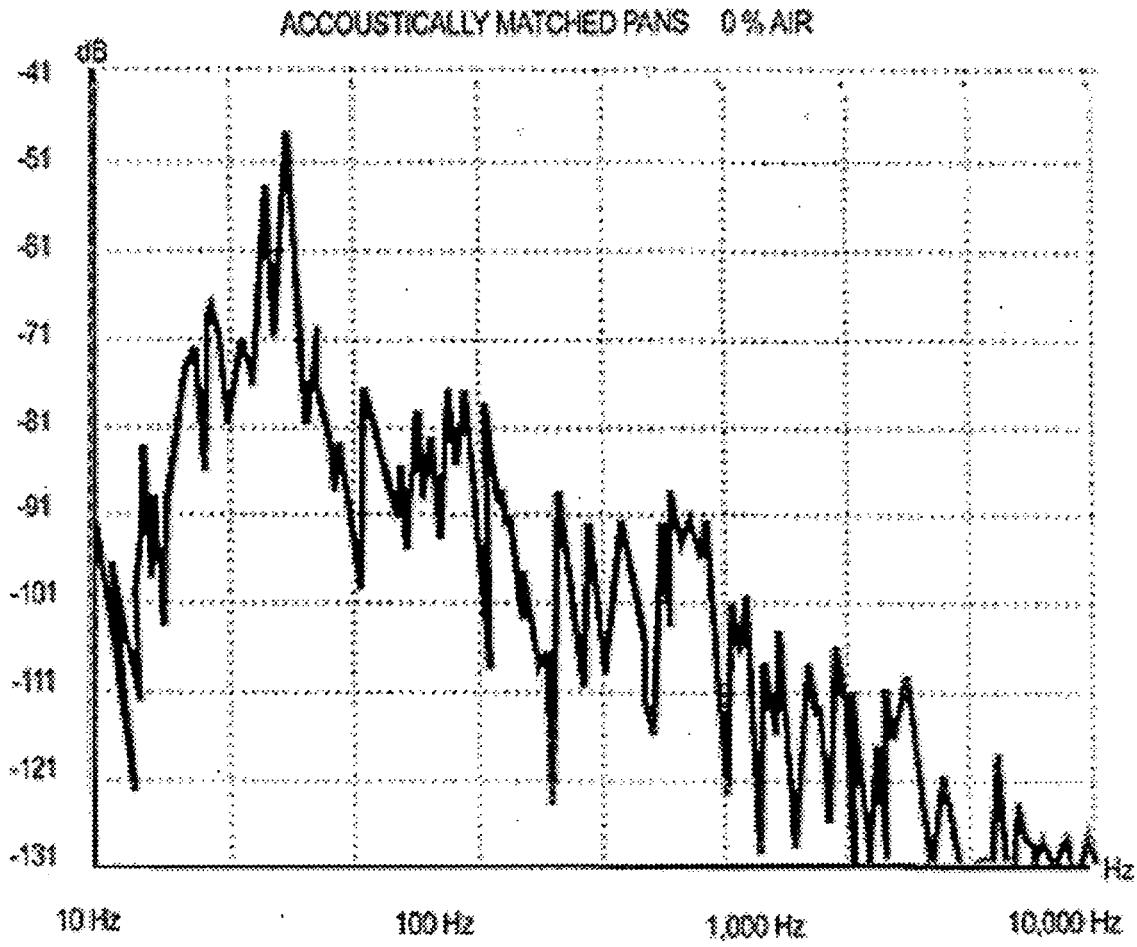
FIG. 11 is a graph similar to FIGS. 8-10 showing observed acoustic energy in a slab with zero percent air entrainment that is being troweled with acoustically-matched pans.

FIG. 11 is a plot of the frequency spectrum of an impedance-matched pan, this time operating over non-air-entrained concrete. The improved vibration transmission into this material shows two effects, both of which enhance the effectiveness of the vibration. First, the impedance match of the concrete and the pans is closer so that more energy is put into the concrete. Second, the sound travels through the concrete more freely since it is not absorbed as strongly as the air-entrained material. As a result, the measured maximum vibration intensity is −46 dB(v), which is over 125 times the intensity shown in FIG. 3. Acoustic energy delivered to the concrete is spread over a wider frequency band, in this case up to a maximum effective frequency of over 1000 Hz.

Figure 12:
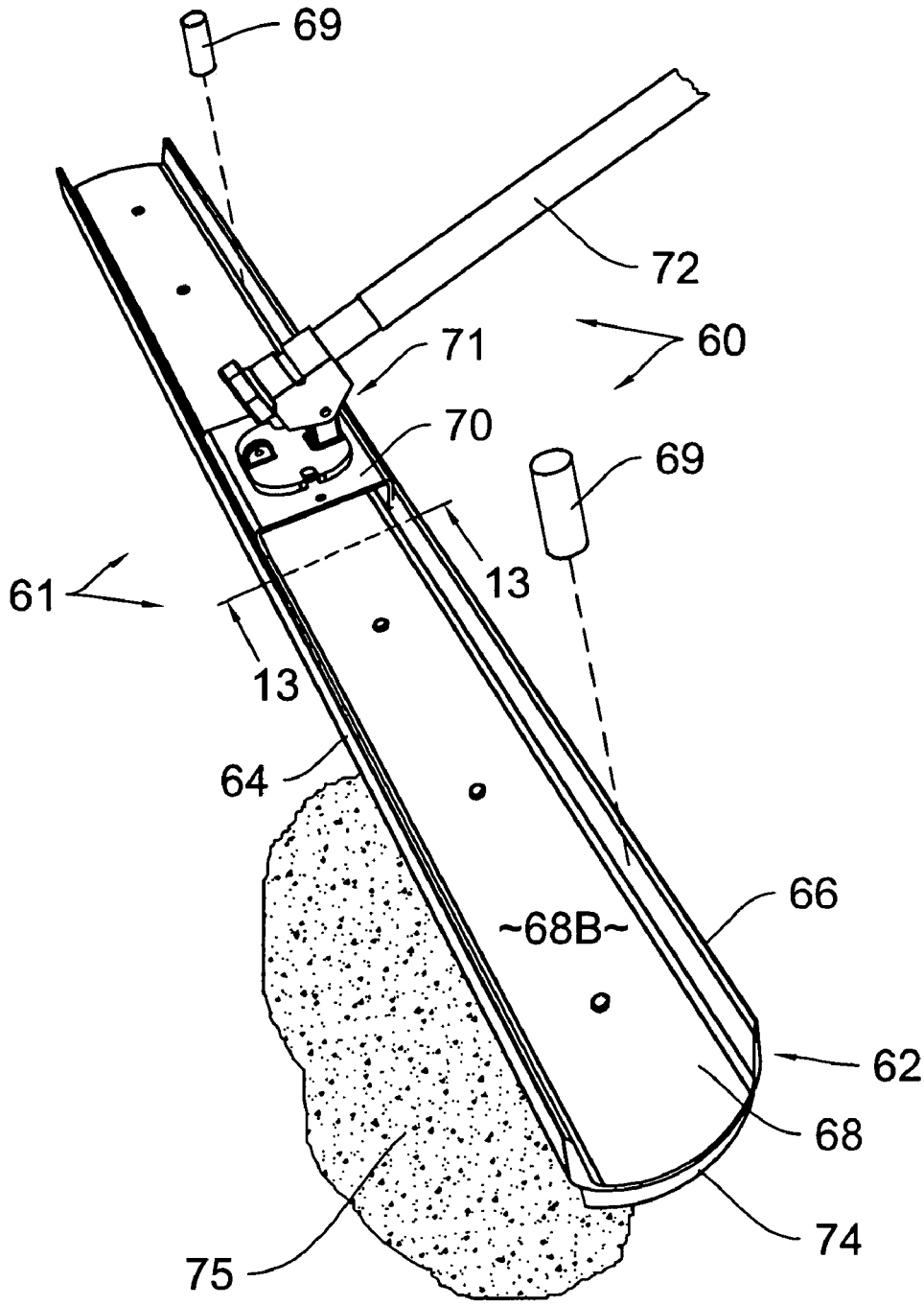
FIG. 12 is a fragmentary, partially exploded isometric view of a first floating screed, with portions thereof broken away for clarity or omitted for brevity.
Figure 13:
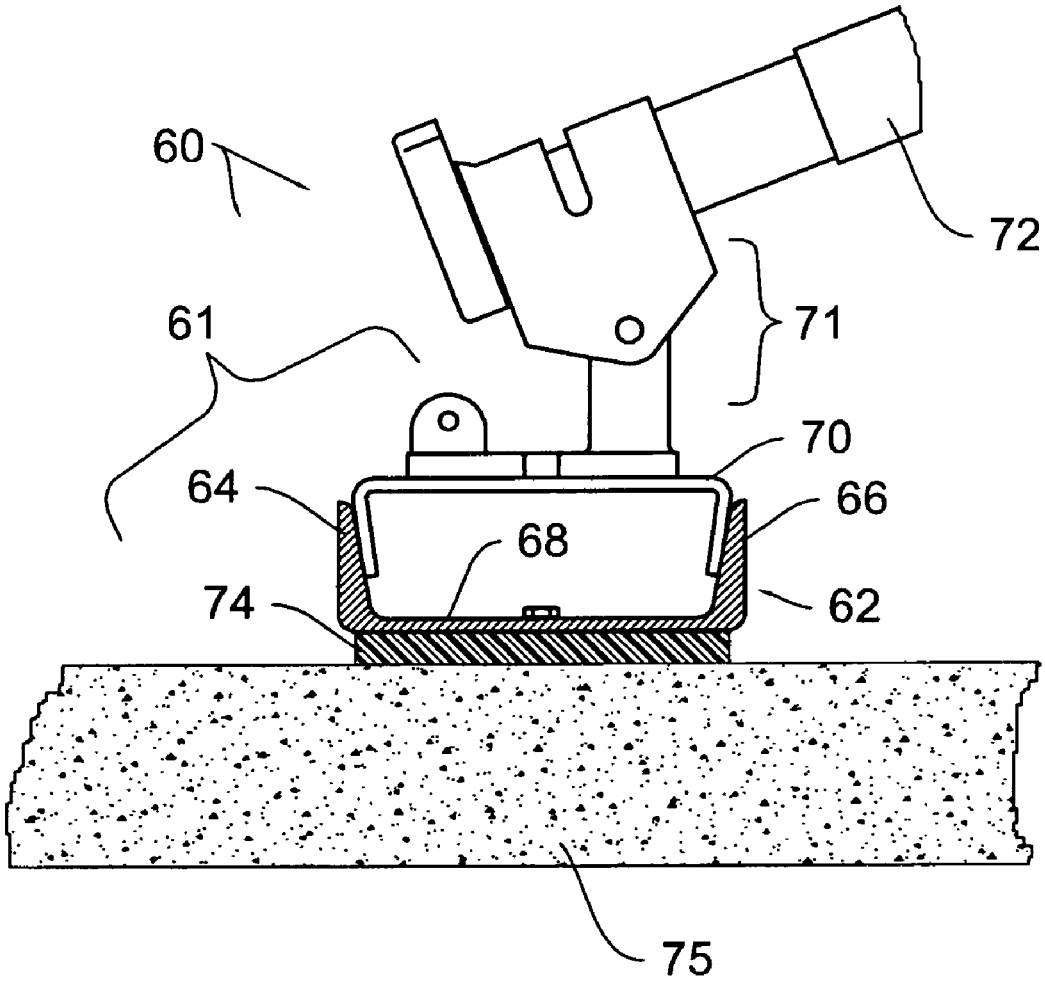
FIG. 13 is an enlarged, fragmentary sectional view of the first floating screed of FIG. 12, taken generally along line 13-13 of FIG. 12.

With reference now directed to FIGS. 12-13, a first floating screed 60 has been acoustically-matched according to the invention. Floating screed 60 comprises an elongated frame 61 made from an extruded, preferably metallic pan 62 that traverses the concrete 75 to be treated. Pan 62 comprises a pair of integral, spaced-apart, upturned edges 64, 66 and an integral, flat bottom 68. Spaced-apart vibrators 69 of conventional construction are mounted upon the frame 61, preferably upon upper surface 68B of the pan bottom 68. Vibrators 69 may be pneumatically or mechanically activated, according to standards well known in the art. Frame 61 is completed by a suitable bracket 70 nested between pan edges 64 and 66. Bracket 70 supports a conventional, adjustable coupling 71 that receives elongated control handle 72, that perpendicularly and angularly extends away from the frame 61.

Importantly, floating screed 60 has a substantially flat, acoustic matching layer 74 affixed to the frame. More particularly, acoustic matching layer 74 is affixed to the frame at the underside of pan bottom 68, and it directly contacts plastic concrete 75, bearing the weight of the screed, and transmitting vibrations from vibrators 69 into the plastic concrete 75 below.

Matching layer 74 is preferably made from ultra-high molecular weight polyethylene (UHMWPE) plastic. Preferably the material has an acoustic impedance within 67% to 150% of the acoustic impedance of the fresh concrete being finished by the power trowel. Preferably the acoustic matching material has an abrasion resistance of no greater than 150 measured using ASTM Method G-65 where steel is given a rating of 100.

When the floating screed 60 is deployed, matching layer 74 directly contacts the plastic concrete 75 being treated, so that vibrational energy imparted to the screed 60, at least in part from the vibrators 69, is optimally transferred to the lower concrete slab 75.

Figure 12A:
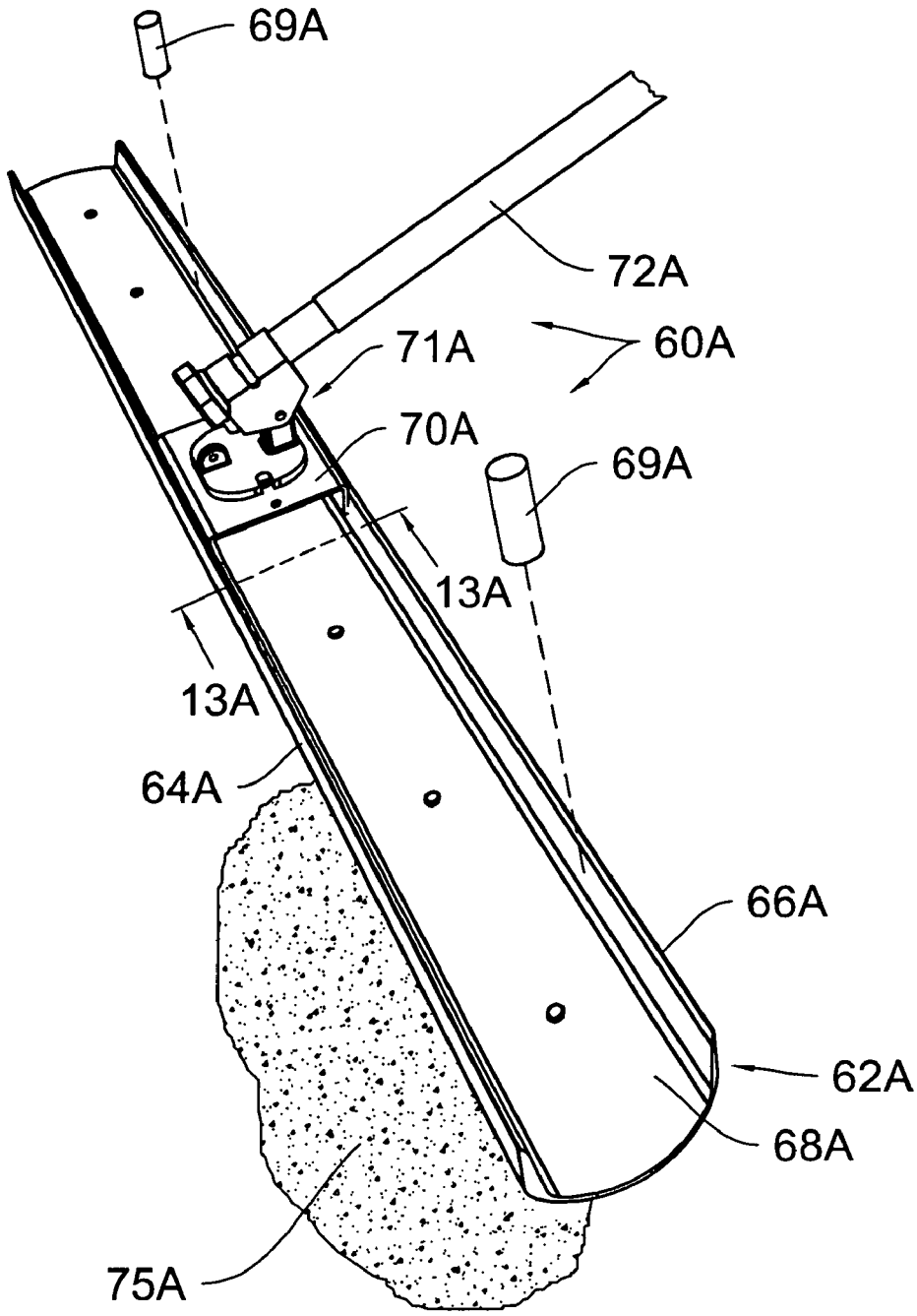
FIG. 12A is a fragmentary, partially exploded isometric view of a second floating screed, with portions thereof broken away for clarity or omitted for brevity.
Figure 13A:
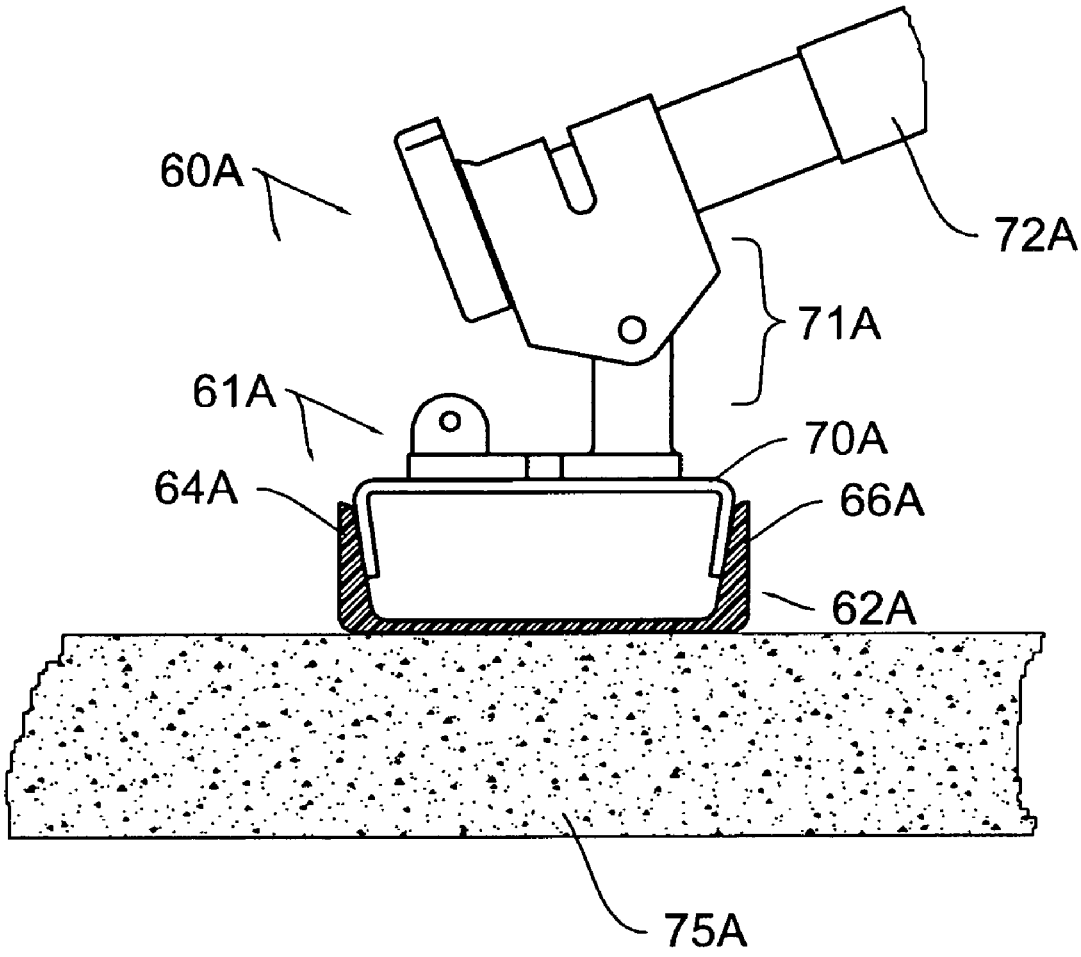
FIG. 13A is an enlarged, fragmentary sectional view of the second floating screed of FIG. 12A, taken generally along line 13A-13A of FIG. 12A.

The second floating screed 60A will be understood with reference to FIGS. 12A and 13A. Floating screed 60A has been acoustically-matched according to the invention. Screed 60A comprises an elongated frame 61A made from a pan 62A similar in shape to pan 62. Pan 62A that traverses the concrete 75A to be treated. Pan 62A comprises a pair of integral, spaced-apart, upturned edges 64A, 66A and an integral, flat bottom 68A that directly contacts concrete 75A. Spaced-apart vibrators 69A of conventional construction are mounted upon the frame 61A, preferably upon pan bottom 68A. Frame 61A has a suitable bracket 70A nested between pan edges 64A and 66A securing coupling 71A that receives elongated control handle 72A.

The second floating screed 60A (FIGS. 12A, 13A) replaces acoustic matching layer 74 of screed 60 (FIGS. 12, 13) by making the entire pan 62A from ultra-high molecular weight polyethylene (UHMWPE) plastic, as was the case with layer 74. When the floating screed 60A is deployed, bottom 68A directly contacts the plastic concrete 75A being treated, and vibrational energy is optimally transferred to the lower concrete slab 75A.

Figure 14:
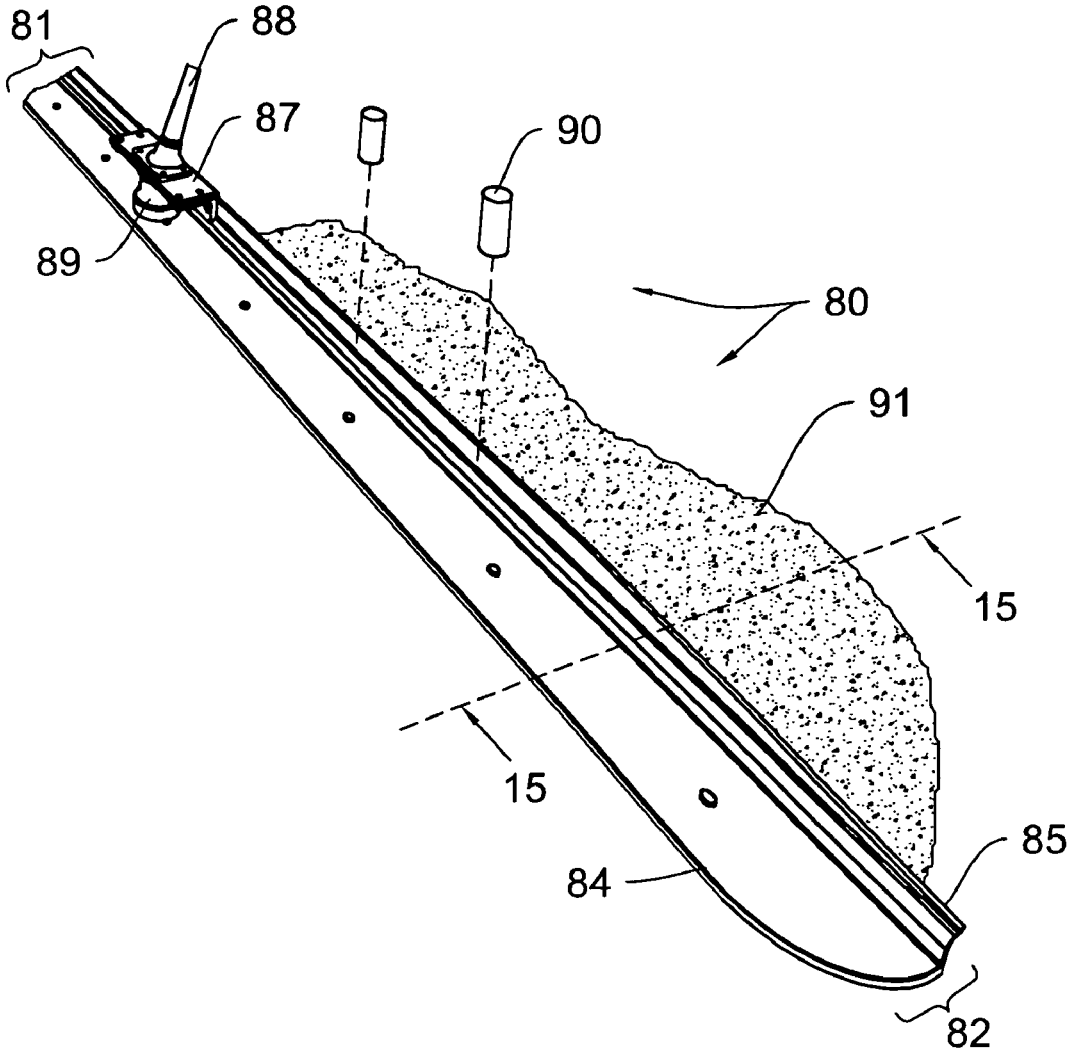
FIG. 14 is a fragmentary, partially exploded isometric view of a third floating screed, with portions thereof broken away for clarity or omitted for brevity.
Figure 15:
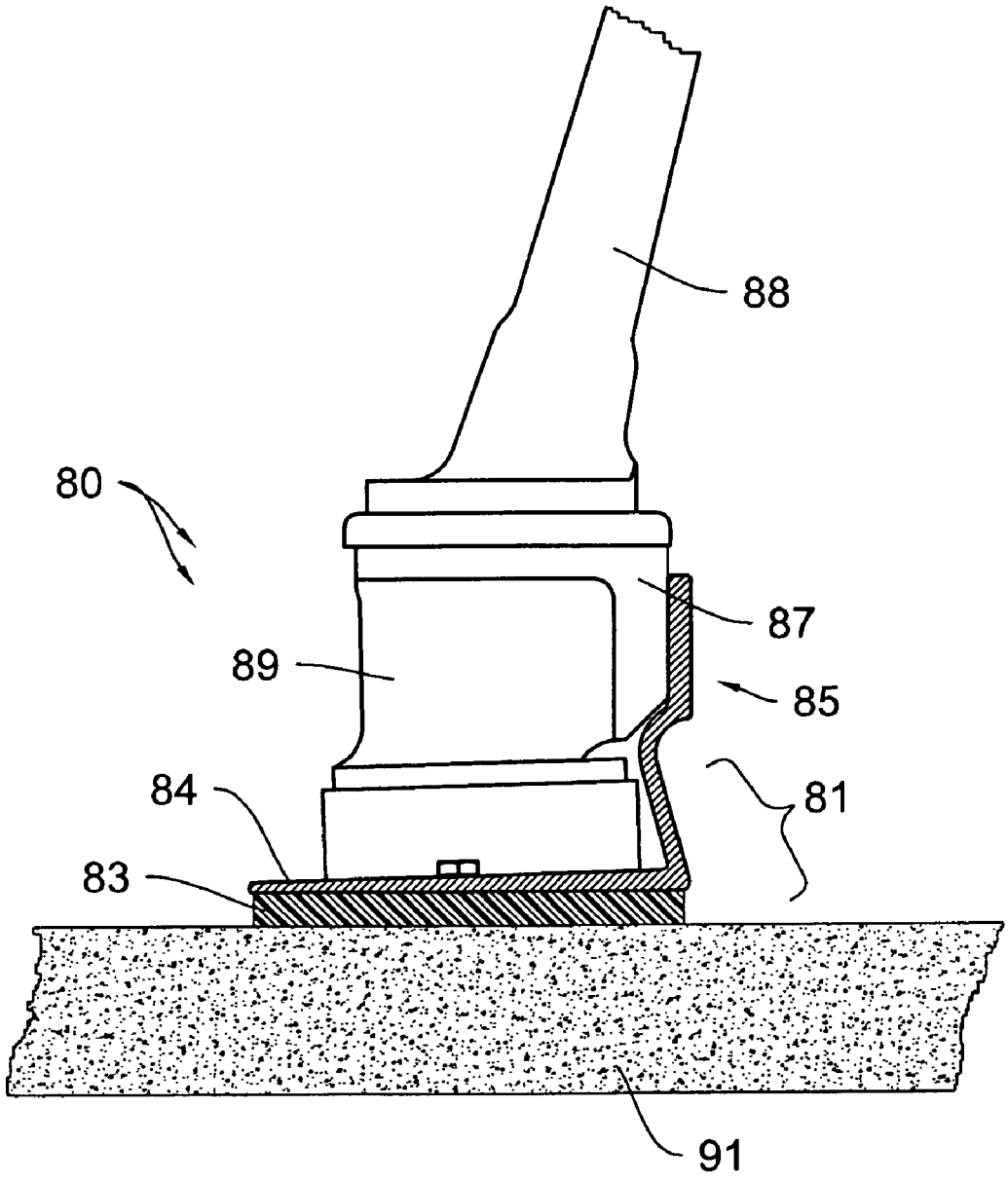
FIG. 15 is an enlarged, fragmentary sectional view of the third floating screed of FIG. 14, taken generally along line 15-15 of FIG. 14.

The third screed 80 illustrated in FIGS. 14 and 15 is also acoustically-matched in accordance with our invention. Screed 80 comprises an elongated frame 81 that traverses the concrete 91 to be treated. Frame 81 comprises a rigid, extruded pan 82 that supports matching material 83. The flat pan bottom 84 is integral with a single upturned edge 85. A bracket 87 secured to edge 85 midway along the length of the frame supports a handle 88 and a lower, rotary vibrator 89. Optionally, a plurality of spaced-apart vibrators 90 may be mounted upon the upper surface of pan bottom 84. Vibrators 90 may be pneumatically or mechanically activated. The substantially flat, acoustic matching layer 83 affixed to the underside of pan bottom 84 directly contacts slab 91. Matching layer 83 is preferably made from ultra-high molecular weight polyethylene (UHMWPE) plastic, similar to the material comprising matching layer 74 previously discussed. When the screed 80 is deployed, vibrational energy is efficiently transmitted between the screed bottom and the lower concrete slab 91.

Figure 14A:
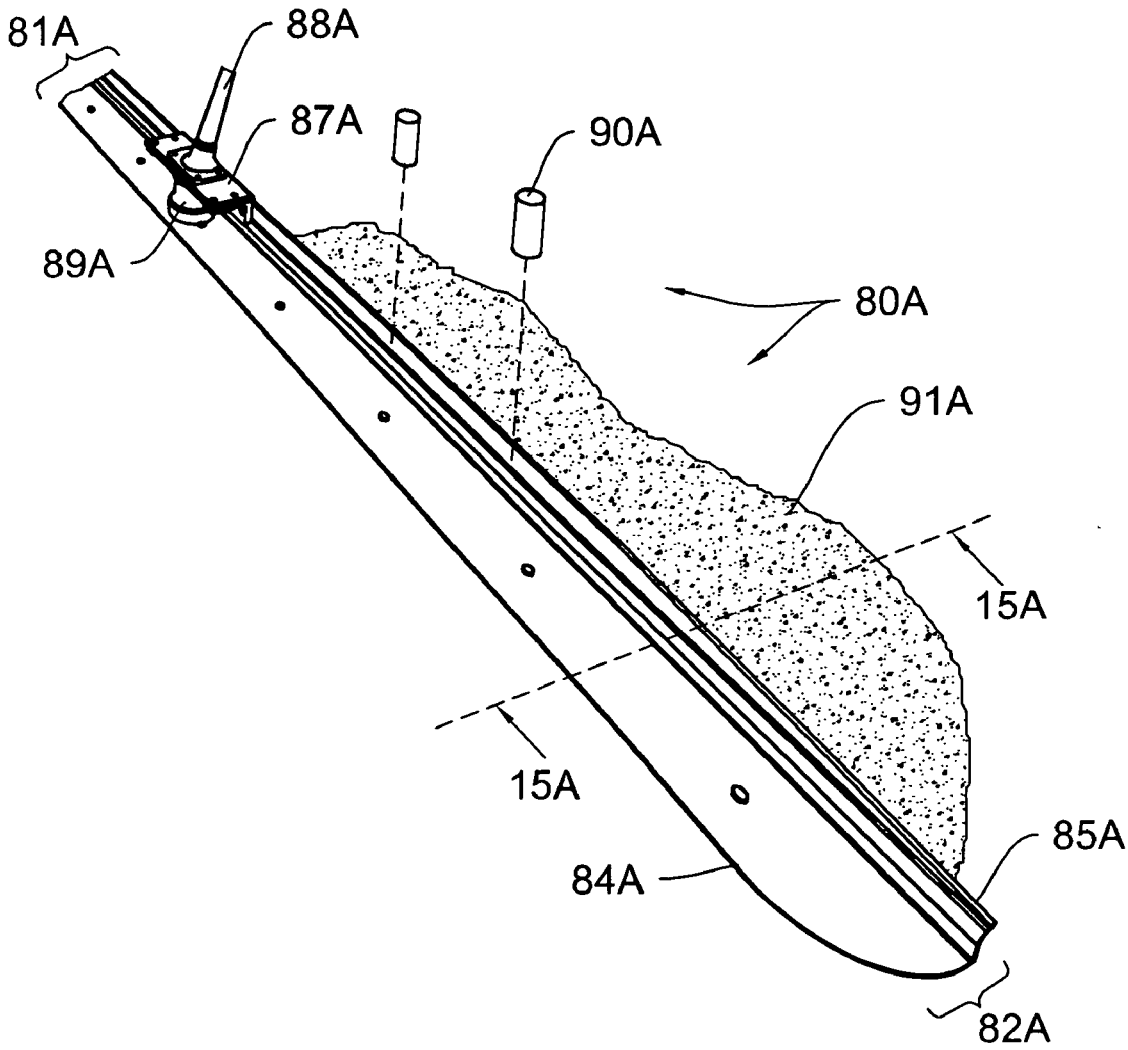
FIG. 14A is a fragmentary, partially exploded isometric view of a fourth floating screed, with portions thereof broken away for clarity or omitted for brevity.
Figure 15A:
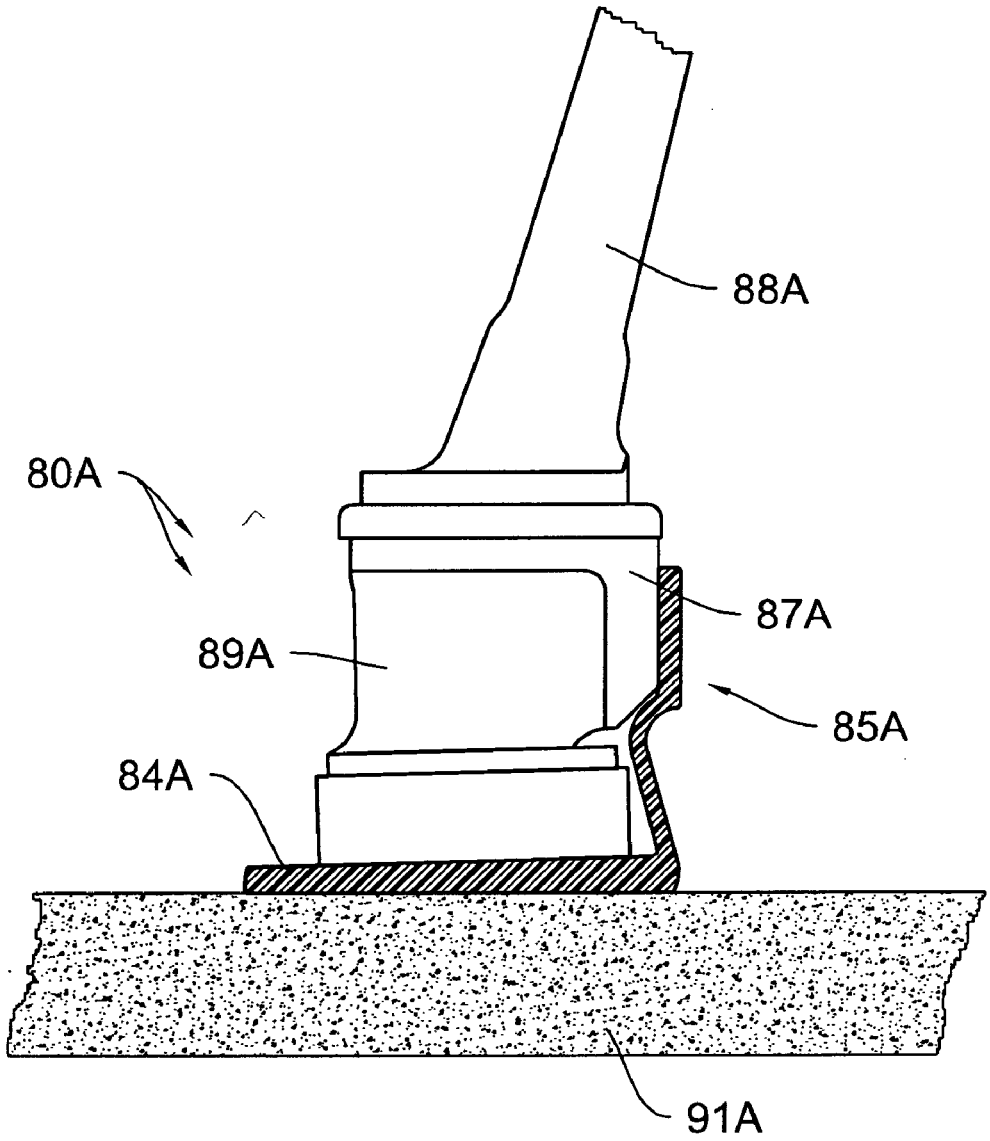
FIG. 15A is an enlarged, fragmentary sectional view of the fourth floating screed taken generally along line 15A-15A of FIG. 14A.

The fourth acoustically-matched screed 80 illustrated in FIGS. 14A and 15A comprises an elongated frame 81A disposed over plastic concrete 91A. Frame 81A comprises a pan 82A made of acoustic matching material. The flat pan bottom 84A is integral with a single, upturned edge 85A. The frame has a bracket 87A secured to pan edge 85A that supports conventional handle 88A and a lower, rotary vibrator 89A. Optionally, spaced-apart vibrators 90A may be mounted upon the frame, directly upon pan bottom 84A. The pan bottom 84A directly contacts slab 91A. Pan 82A is preferably made from ultra-high molecular weight polyethylene (UHMWPE) plastic. When the screed 80A is deployed, vibrational energy is efficiently transmitted between the bottom 84A and the lower concrete slab 91A.

Figure 16:
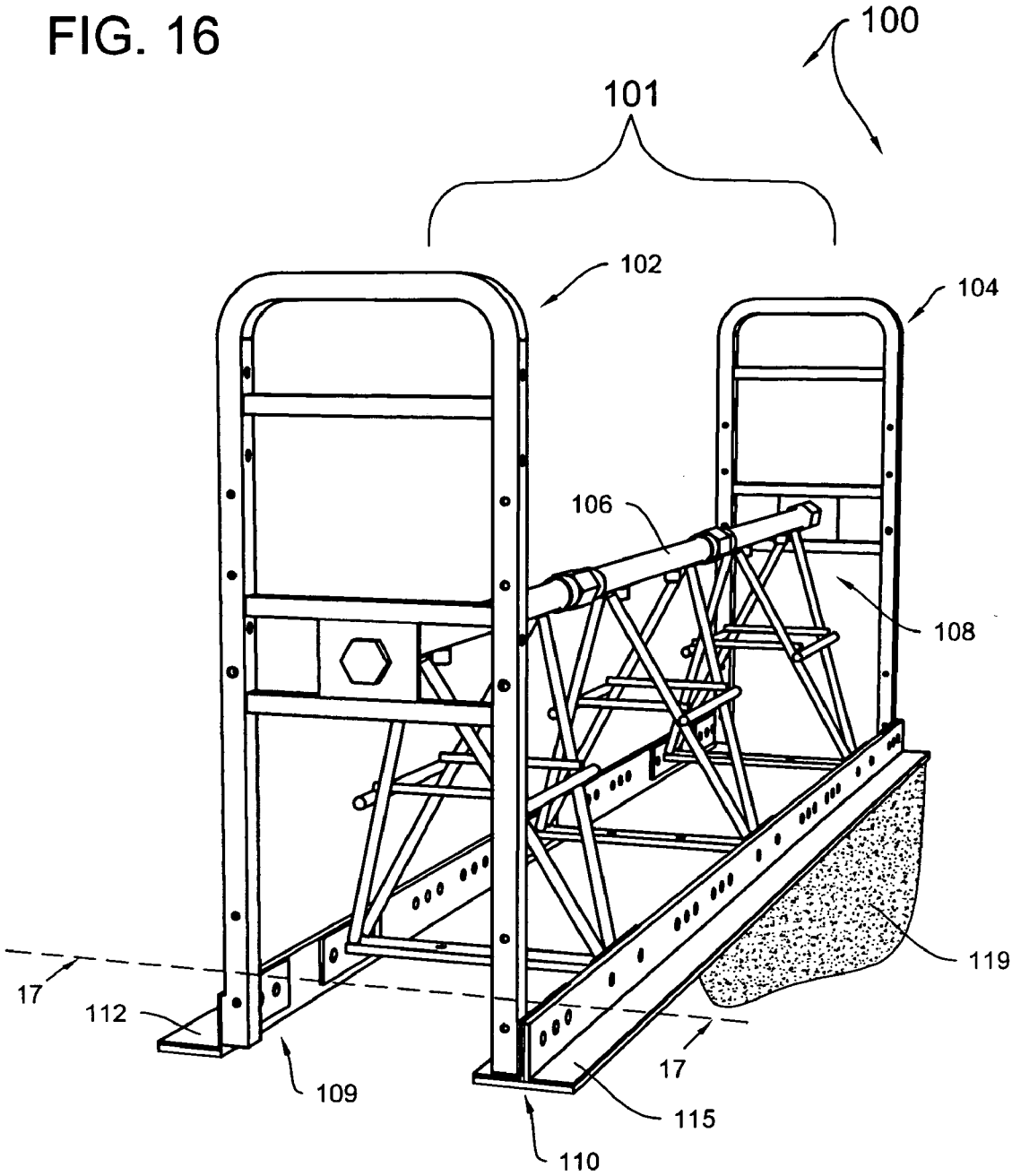
FIG. 16 is a fragmentary, partially exploded isometric view of a triangular truss screed, with portions thereof broken away for clarity or omitted for brevity.
Figure 16A:
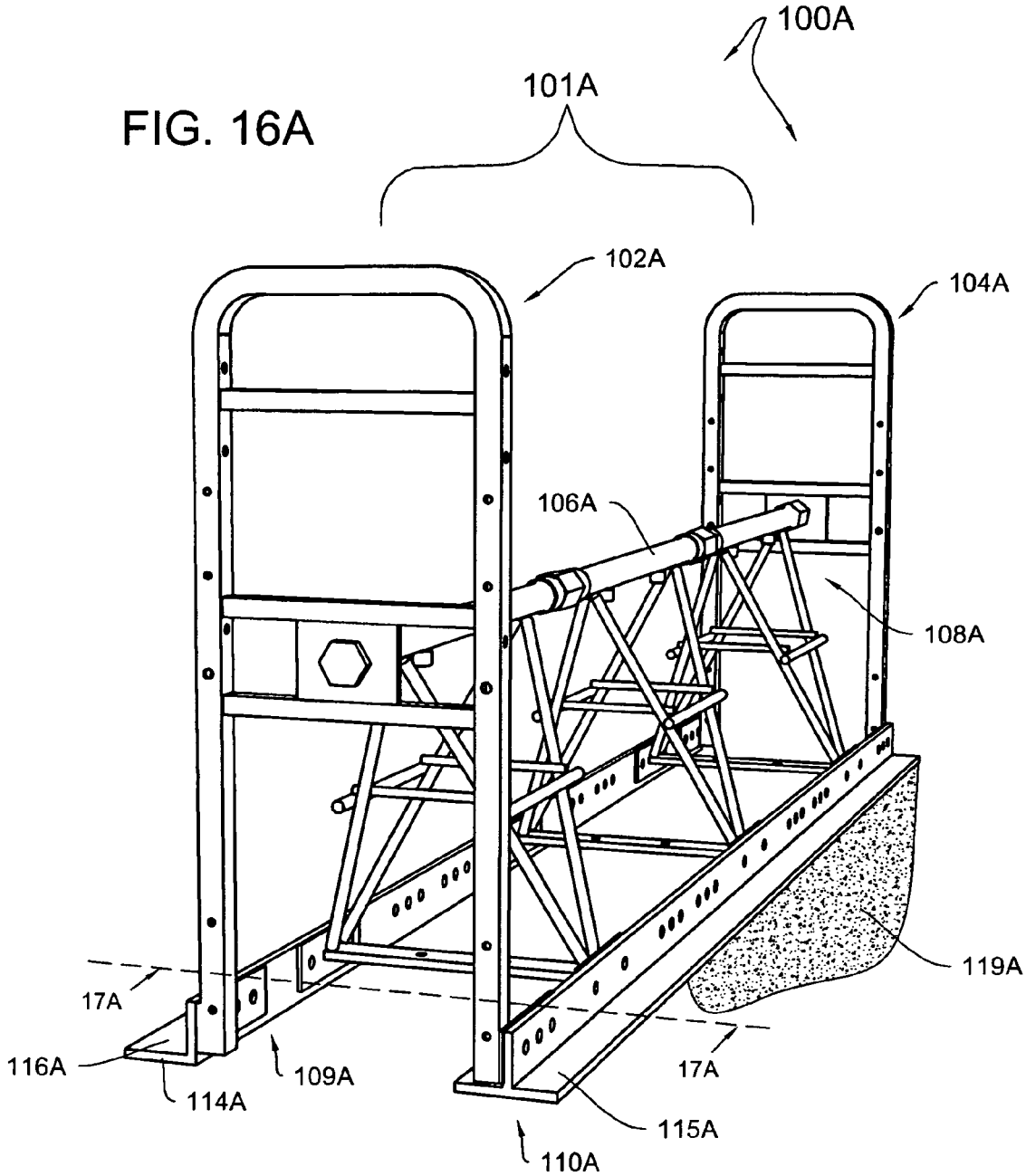
FIG. 16A is a fragmentary, partially exploded isometric view of an alternative triangular truss screed, with portions thereof broken away for clarity or omitted for brevity.
Figure 17:
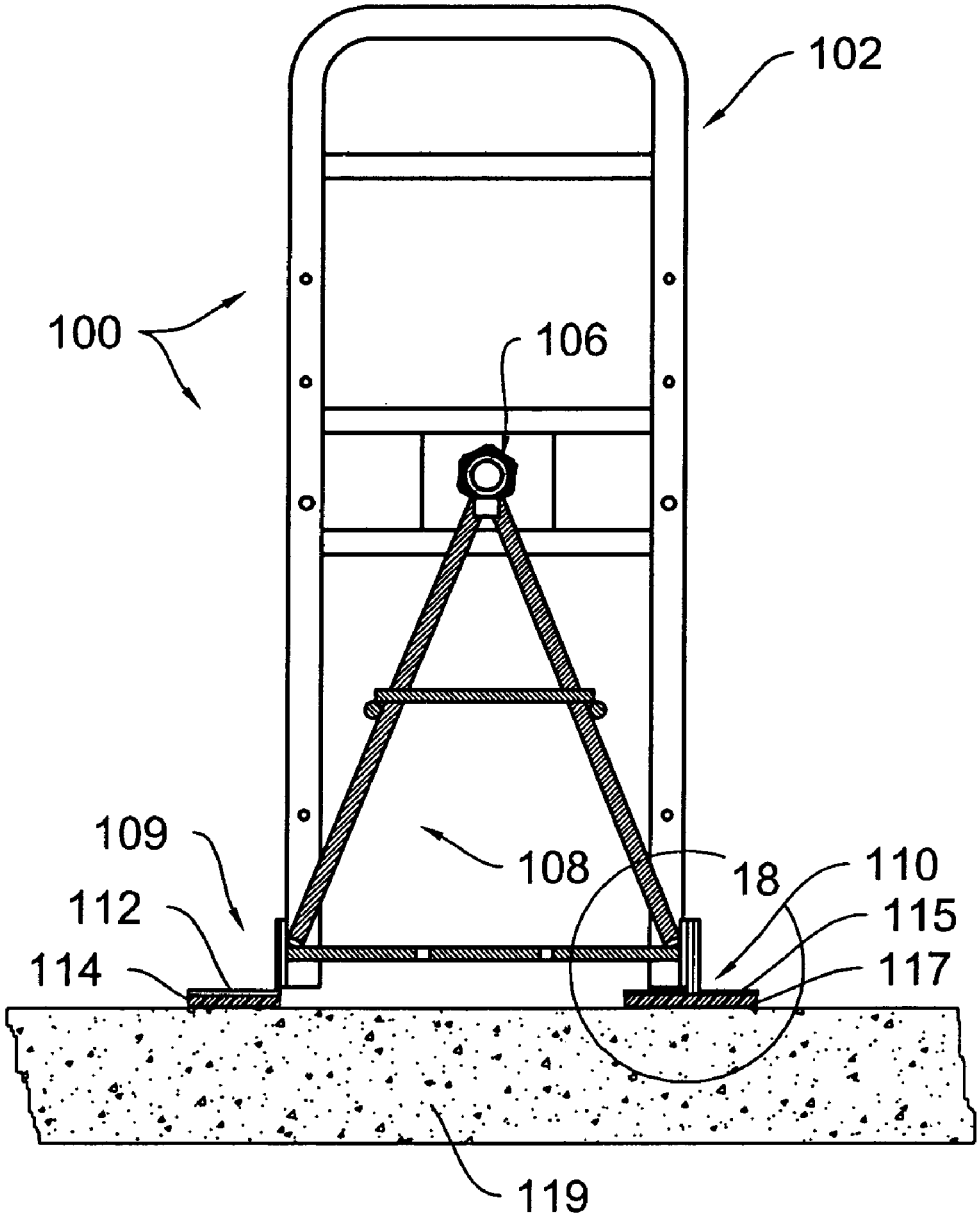
FIG. 17 is an enlarged, fragmentary sectional view of the triangular truss screed of FIG. 16, taken generally along line 17-17 of FIG. 16.
Figure 18:
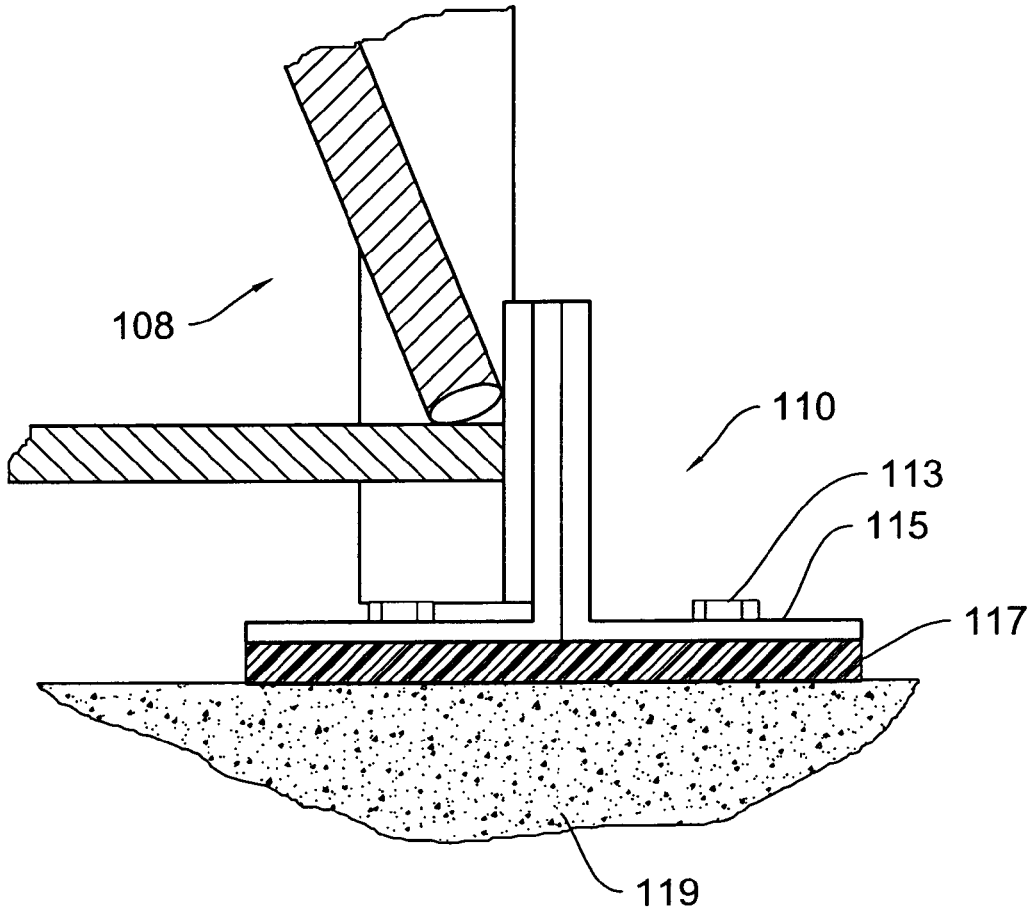
FIG. 18 is an enlarged fragmentary view derived from circled region 18 in FIG. 17.
Figure 18A:
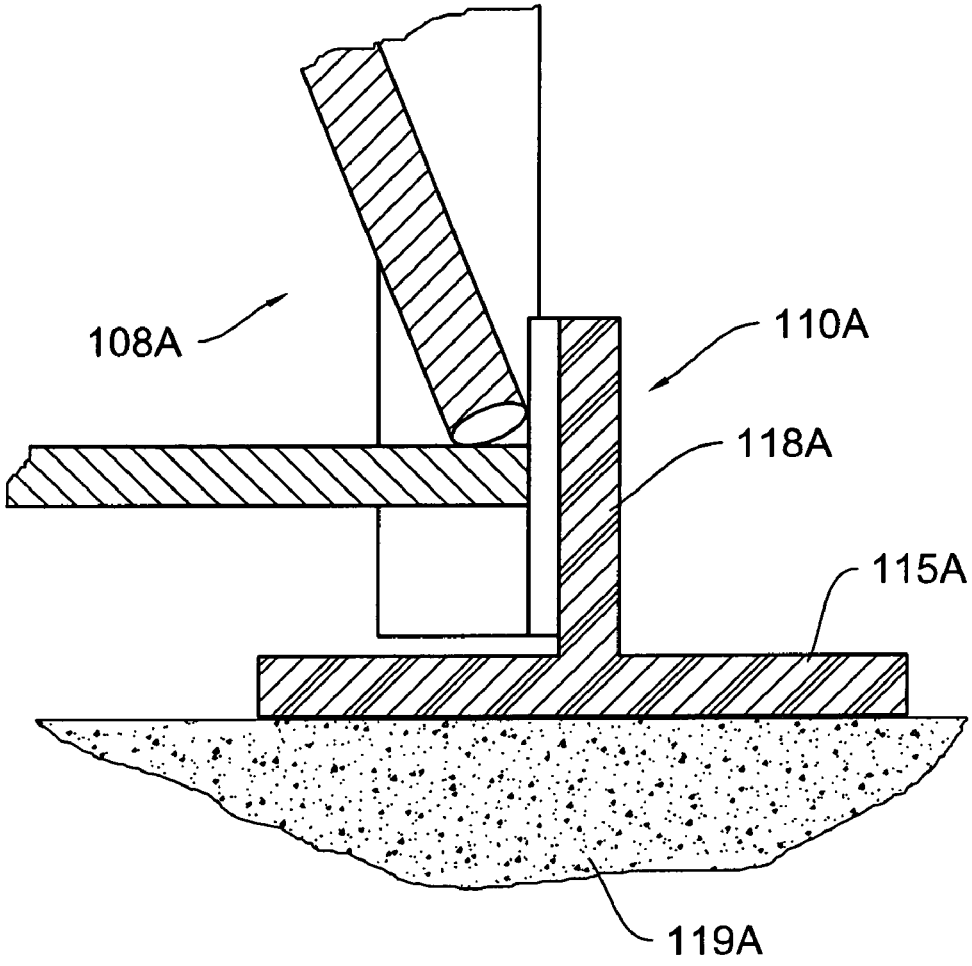
FIG. 18A is an enlarged fragmentary view derived from circled region 18A in FIG. 17A.
Figure 19:
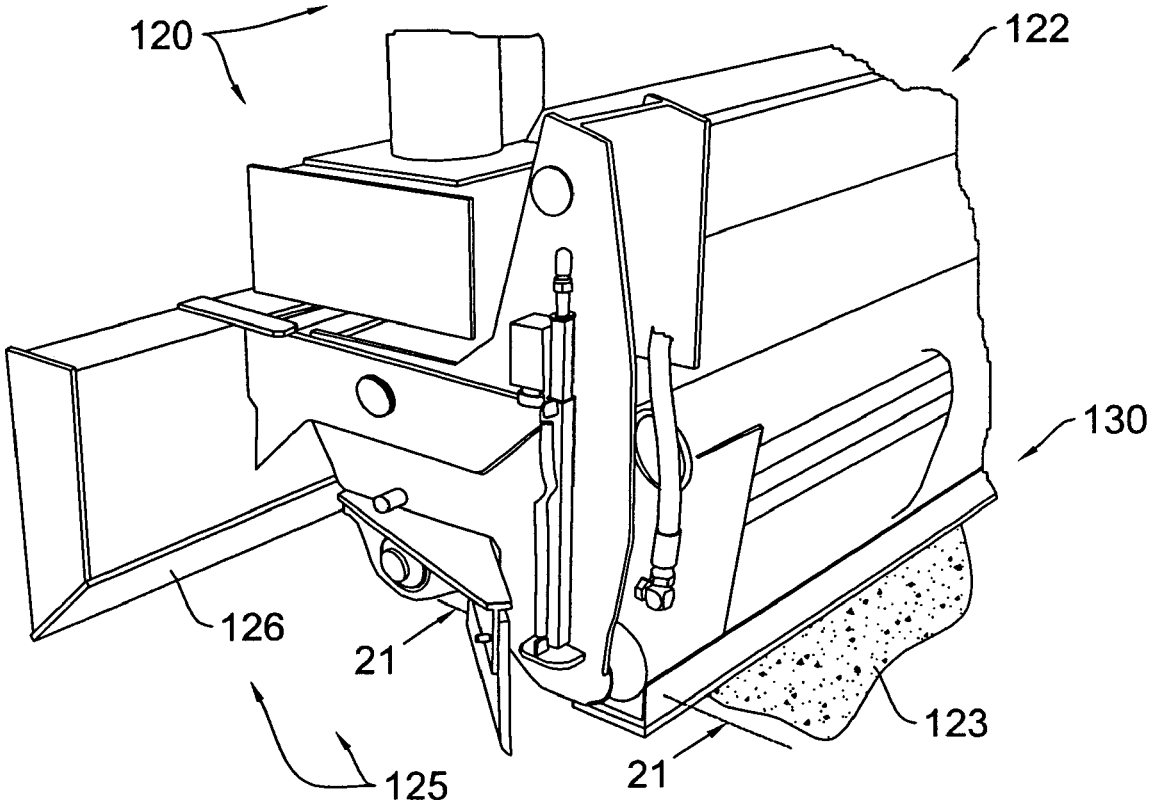
FIG. 19 is a fragmentary, partially exploded isometric view of a telescopic boom screed, with portions thereof broken away for clarity or omitted for brevity.
Figure 19A:
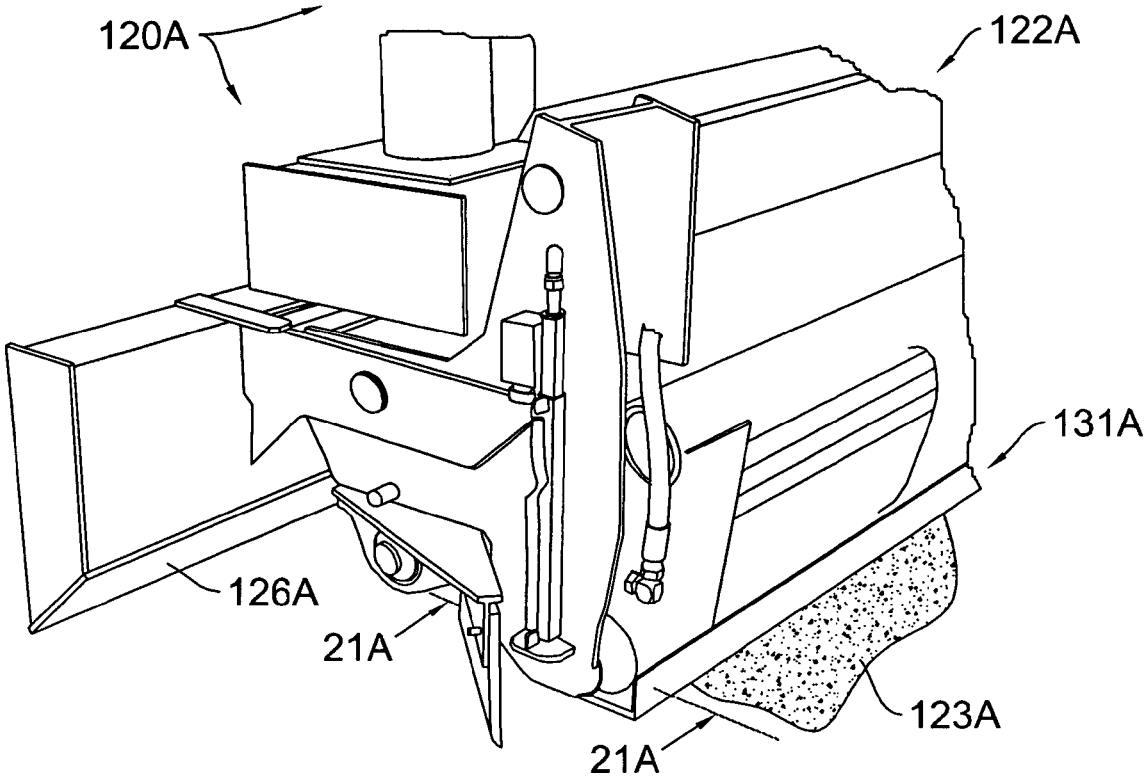
FIG. 19A is a fragmentary, partially exploded isometric view of an alternative telescopic boom screed, with portions thereof broken away for clarity or omitted for brevity.
Figure 20:
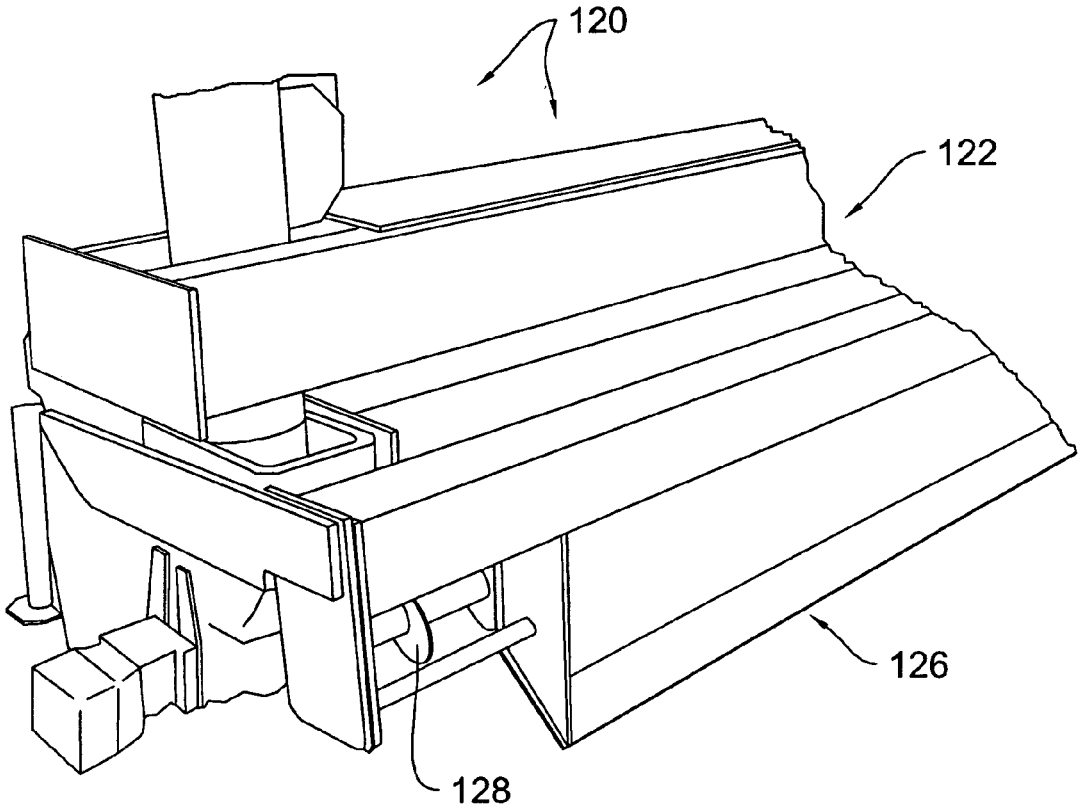
FIG. 20 is a fragmentary, partially exploded isometric frontal view of the screeding head associated with the telescopic boom screed of FIG. 19, with portions thereof broken away for clarity or omitted for brevity.
Figure 20A:
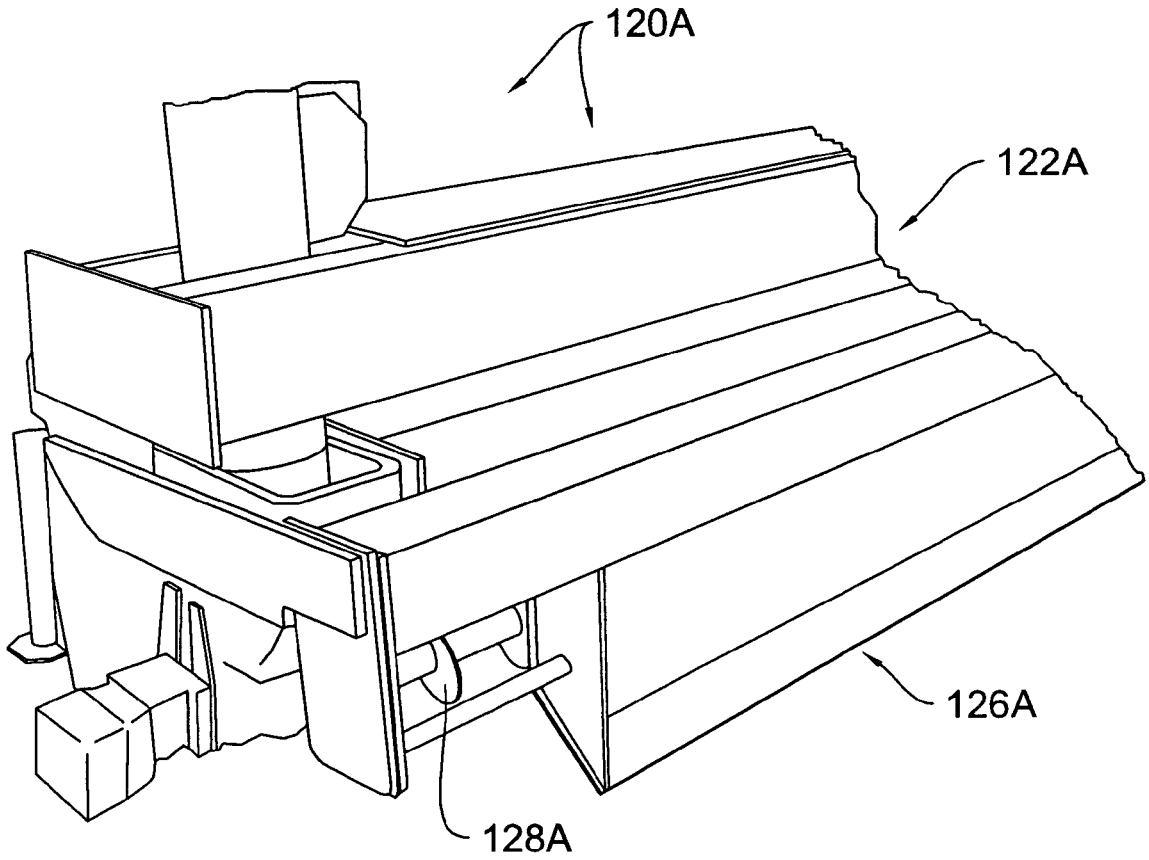
FIG. 20A is a fragmentary, partially exploded isometric frontal view of the screeding head associated with the alternative telescopic boom screed of FIG. 19A, with portions thereof broken away for clarity or omitted for brevity.

A modified triangular truss screed 100 illustrated in FIGS. 16-18 is also acoustically-matched. Triangular truss screed 100 has a frame 101 that traverses the concrete to be finished, extending between and resting upon conventional forms. Frame 101 comprises a pair of conventional, upright end brackets 102, 104 between which an elongated top pipe 106 extends. The top pipe 106 is secured atop conventional truss structure, generally designated by the reference numeral 108, which is in turn supported upon and between spaced-apart, parallel blades 109 and 110.

Blade 109 (FIG. 16) is generally "L-shaped" in cross section, and comprises a blade bottom portion 112 (FIG. 17) whose underside is coupled to an acoustic matching layer 114 with fasteners 113 (FIG. 18). Blade 110 has a cross section shaped like an inverted "T." An analogous blade bottom portion 115 supports another acoustic matching layer 117 (FIGS. 17-18). Matching layers 114 and 117 directly contact the concrete slab 119, and are made from UHMWPE plastic material. Vibration is imparted to screed 100 through conventional means well known in the art. During screed operation, vibrational energy is efficiently transmitted between the screed blade bottom portions and the lower concrete slab 119.

Figure 17A:
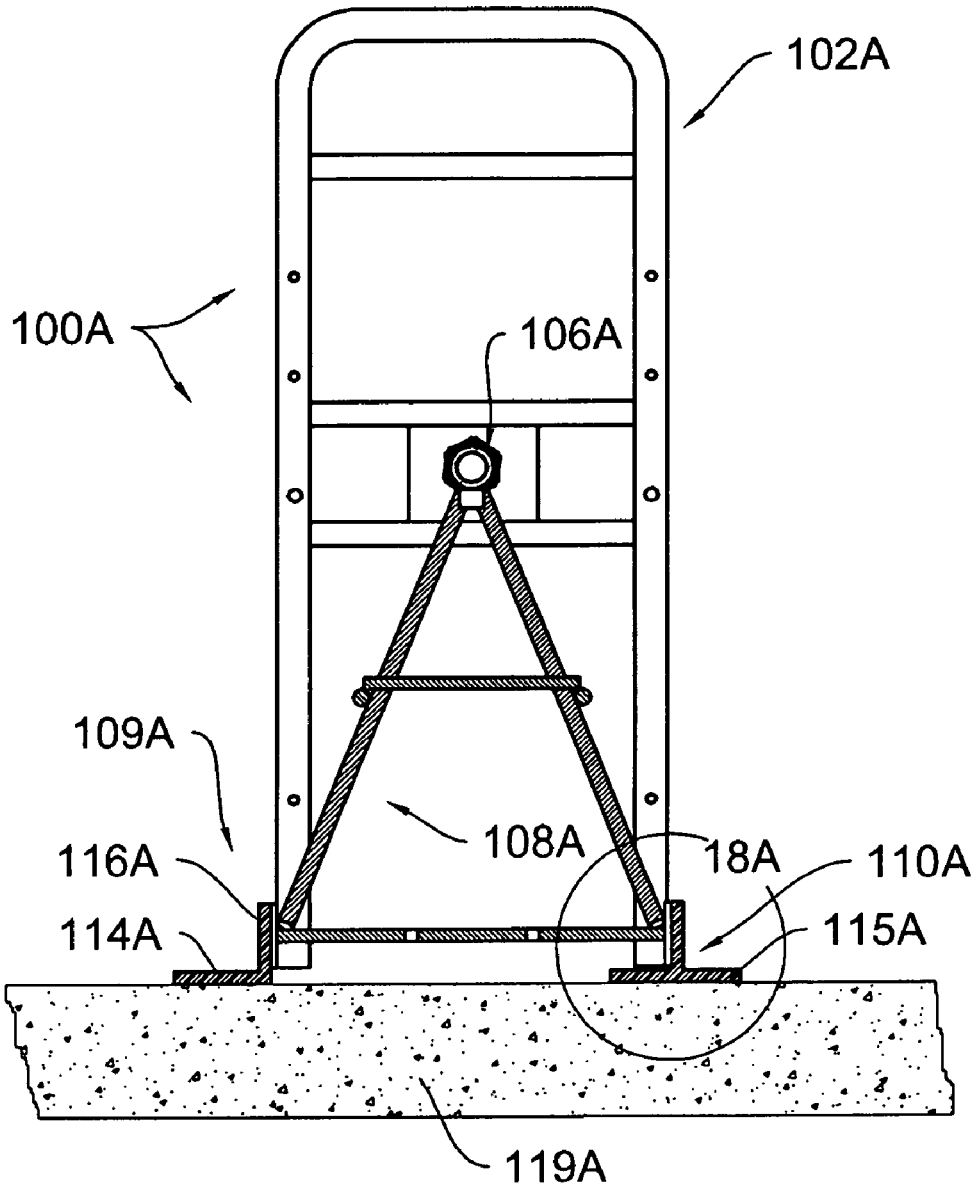
FIG. 17A is an enlarged, fragmentary sectional view of the alternative triangular screed of FIG. 16A, taken generally along line 17A-17A of FIG. 16A.

A second, acoustically-matched triangular truss screed 100A illustrated in FIGS. 16A-18A has a frame 101A comprising a pair of conventional, upright end brackets 102A, 104A between which an elongated top pipe 106A extends. Pipe 106A is secured atop truss structure 108A, supported upon and between spaced-apart, parallel blades 109A and 110A, which are both made from UHMWPE plastic for acoustic matching Blade 109A (FIG. 16A) is generally "L-shaped" in cross section, Blade 109A has a flat blade bottom portion 114A (FIGS. 16A, 17A) that directly contacts the concrete 119A, and an integral vertical portion 116A connected to end bracket 102A.

The companion blade 110A has a cross section shaped like an inverted "T." Bottom portion 115A directly contacts the concrete slab 119A. Integral vertical blade portion 118A is secured to the frame. Blade portions 115A and 118A and are made from UHMWPE plastic material.

Figure 21:
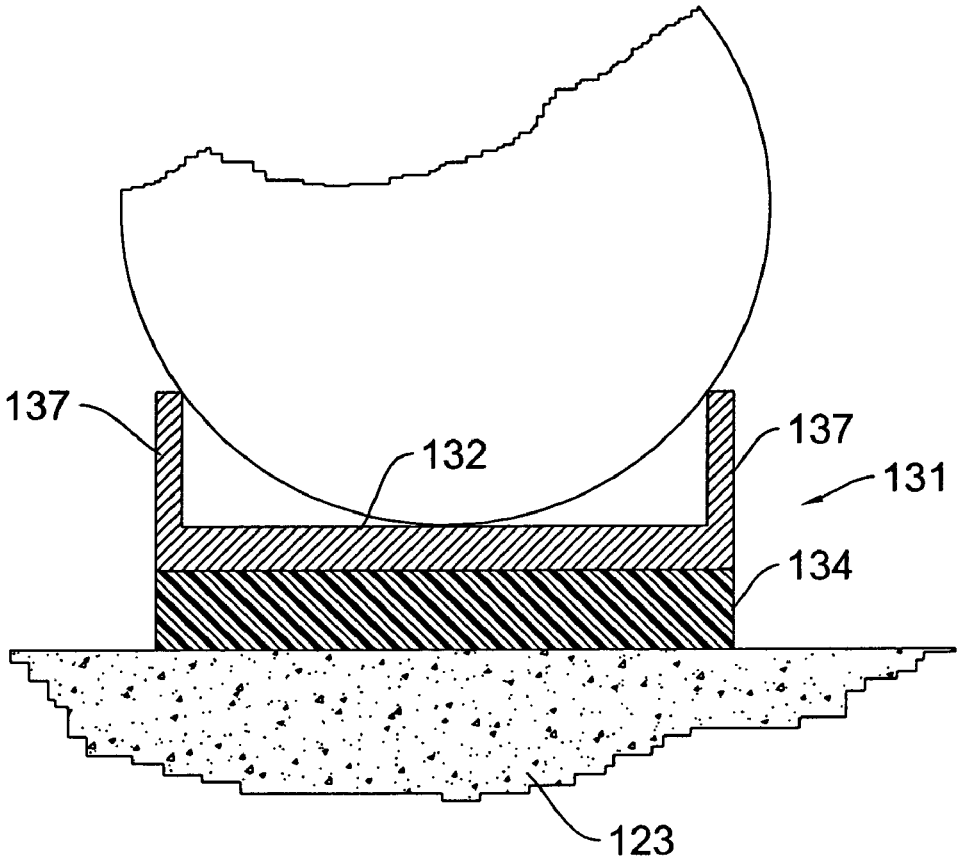
FIG. 21 is an enlarged, fragmentary sectional view taken generally along lines 21-21 FIG. 19.
Figure 22:
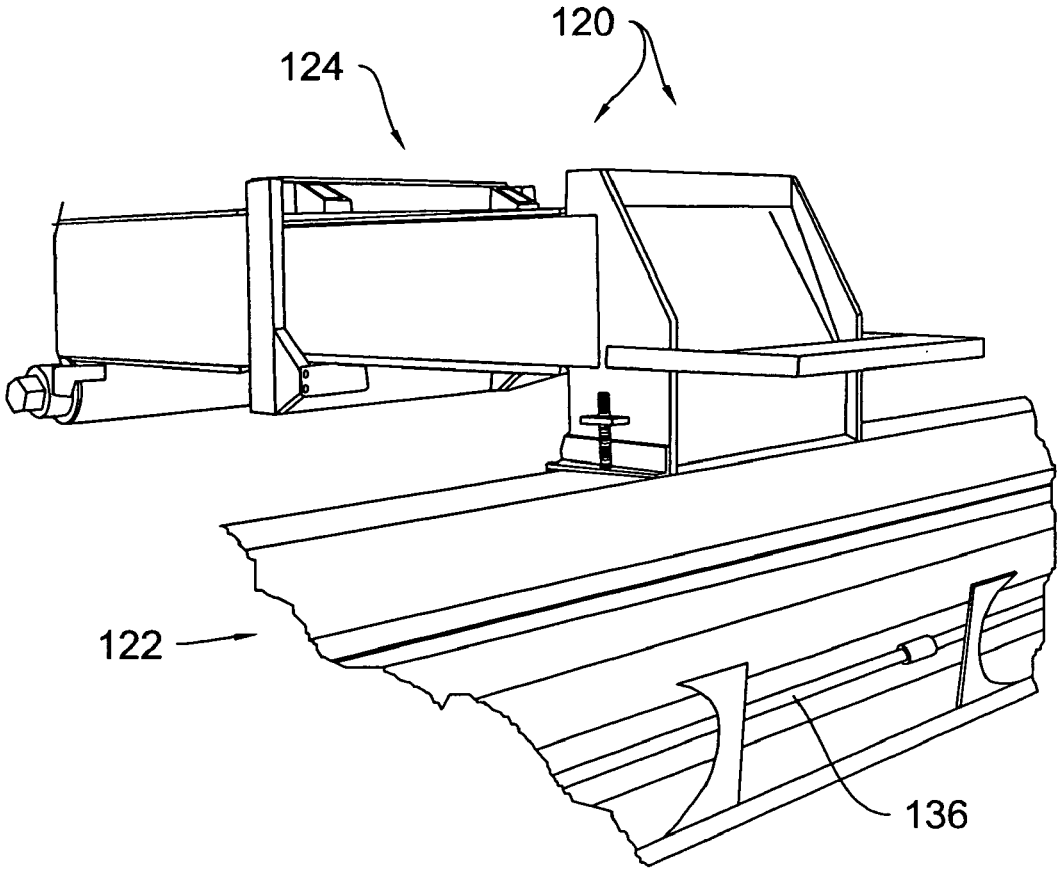
FIG. 22 is a fragmentary, partially exploded isometric rear view of the screeding head associated with the telescopic boom screed of FIG. 19, with portions thereof broken away for clarity or omitted for brevity; and, FIG. 22A is a fragmentary, partially exploded isometric rear view of the screeding head associated with the alternative telescopic boom screed of FIG. 19A, with portions thereof broken away for clarity or omitted for brevity.

A telescopic boom screed 120 illustrated in FIGS. 19-22 is acoustically-matched through similar means. Boom screed 120 comprises a remote screed head 122 that contacts plastic concrete slab 123. Head 122 is formed from an elongated frame 125 recognized by those skilled in the art, that transverses the concrete to be finished. Head 122 is supported by a retractable, telescoping boom 124 (FIG. 22). As will be recognized by those with skill in the art, a concrete forming plow 126 is disposed at the head front. Movement of raw concrete is encouraged by conventional auger 128 and plow 126. Vibration is imparted through conventional eccentrics driven by vibrator shaft 136 (FIG. 22), as is well known in the art. A screed strike-off 130 at the rear of head 122 comprises a generally "U-shaped" blade 131 with a flat bottom portion 132 whose underside is coupled to acoustic matching layer 134 (FIG. 21). A UHMWPE plastic matching layer 134 directly contacts the concrete slab 123 (FIG. 21).

Figure 22A:
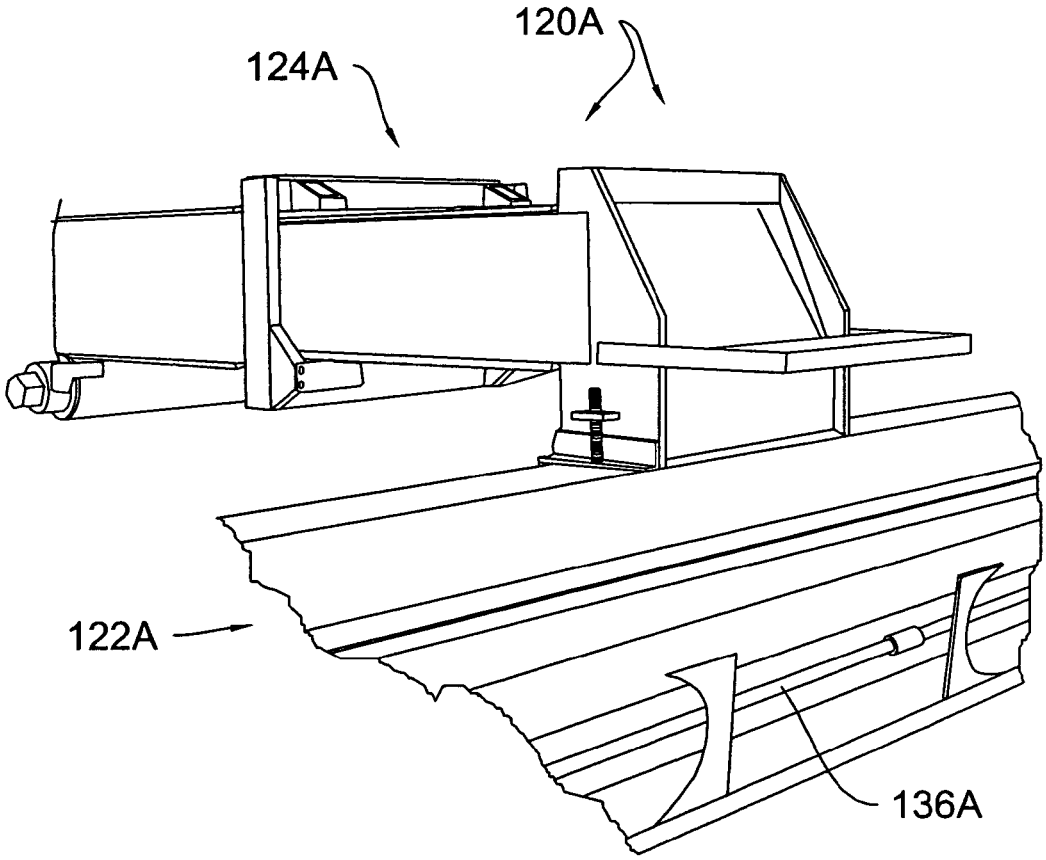

An alternative telescopic boom screed 120A illustrated in FIGS. 19-22 comprises a remote screed head 122A that contacts slab 123A. Head 122A is formed from an elongated frame 125A. Head 122A is supported by a retractable, telescoping boom 124A (FIG. 22A). Concrete forming plow 126A is disposed at the head front. Movement of raw concrete is encouraged by conventional auger 128A and plow 126A. Vibration is imparted through conventional eccentrics driven by vibrator shaft 136A (FIG. 22A).

Figure 21A:
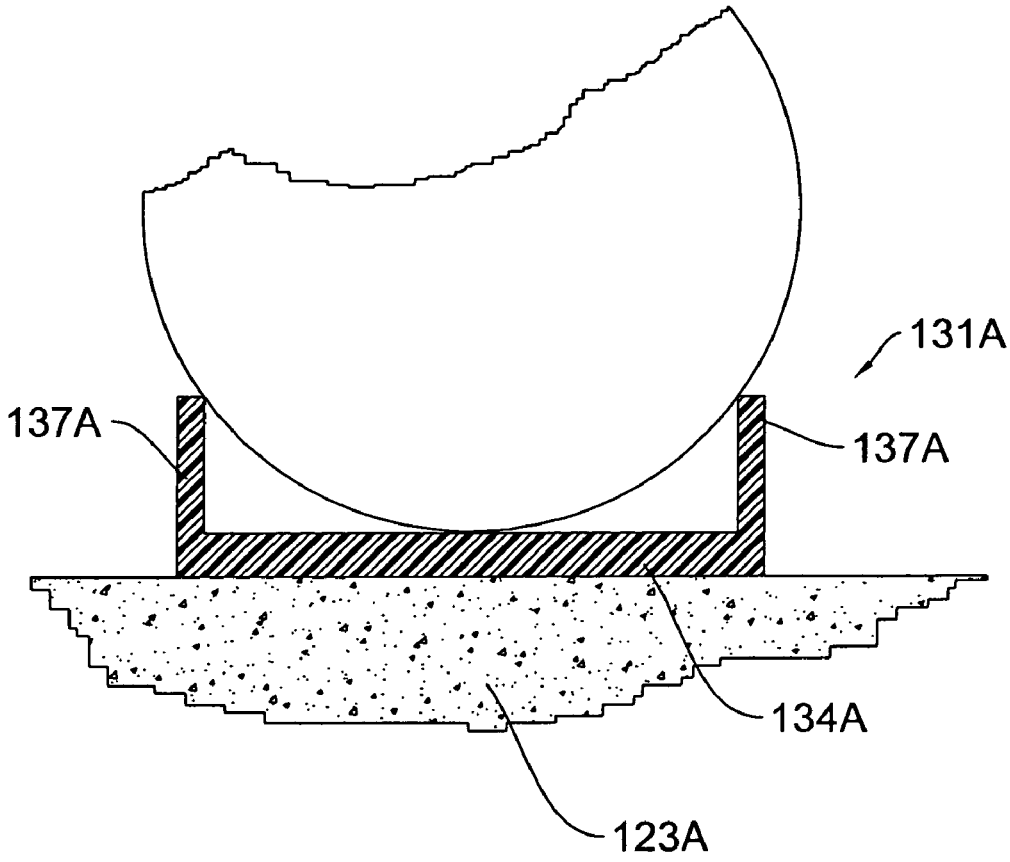
FIG. 21A is an enlarged, fragmentary sectional view taken generally along lines 21A-21A of FIG. 19A.

The previously described screed strike-off 130 has been replaced with a plastic blade 131A (FIG. 21A) at the rear of head 122A. This generally "U-shaped" blade is made from UHMWPE plastic. A pair of upturned sides 137A are integral with a flat bottom portion 134A that contacts the concrete slab 123A (FIG. 21A).

EXAMPLE 1

In testing prior concepts leading to the invention, numerous six-inch concrete slabs were laid directly on a graded dirt base. The slabs were finished using dual-pan, power rider trowels employing acoustically matched float pans. The slabs were arranged in line, end to end, with the first slab at the southern-most position followed by subsequent slabs abutting toward the north. Slab edges to the east were defined by an existing slab of similar dimensions; all other edges were made of steel forms which were removed after the slabs achieved adequate strength. The forms at the abutting edges of these slabs were replaced with one-inch by six-inch wooden planks prior to pouring the next slab.

Thermocouples were placed in the forms before the concrete was poured, and acoustic spectral analysis was conducted during the finishing process to evaluate performance. UHMWPE pans with an impedance that matches fresh concrete were compared to steel pans with impedances about twenty times higher. The entrained air content of concrete was measured. Slab characteristics were as follows:

TABLE 7

Summary Of Slab Parameters

| Slab Designation | Slab #1 | | | Slab #2 | | Slab #3 |
|---|---|---|---|---|---|---|
| Ticket Number | 19929 | 19931 | 19938 | 19944 | 19946 | 19952 |
| Yards Delivered | 7.0 | 9.5 | 10.5 | 17.5 | 20.5 | 9.0 |
| Time On Ticket | 8:18 | 8:35 | 9:24 | 12:32 | 12:47 | 13:51 |
| Slump Measured | 4.5" | 5.5" | | 3" | | 4.75" |
| Entrained Air Measured | 6.5% | | | 5.5% | | 3.5% |
| Water Added On Site | 8 gal | 0 | 4 gal | 23 gal | 10 gal | 0 |
| Concrete Temperature | 84 deg | | | 87 deg | | 87 deg |

Flatness readings on adjacent finished slabs for forty-six inch steel pans and UHMWPE materials were as follows:

TABLE 8

Pan Flatness comparison:

| Segment | Steel Pan Flatness (Slab 1) | UHMWPE Flatness (Slab 2) |
|---|---|---|
| E-W North End | 45.1 | 21.3 |
| W-E South End | 55.6 | 38.5 |
| S-N East End | 37.5 | 27.6 |
| S-N West End | 36.7 | 35.4 |
| Overall | 42.1 | 28.4 |

Slab #1 was poured, allowed to set, floated with a regular steel pan and then troweled with steel blades, all using a 46" power trowel. When floating was complete on the first slab, the second slab was poured. There was a delay between pouring the first and second loads of concrete, so floating of the first portion of the second slab approached completion before the second portion was ready to float. The situation was intensified due to the apparent high slump of the second load of concrete, although that slump was not measured. In any case, floating of the second slab required nearly two hours. The second slab experienced very little surface delamination, despite entrained air. In contrast, the first slab showed delamination, although it was not troweled before the water sheen had dissipated.

EXAMPLE 2

On Oct. 22-23, 2002, at Paragould, Ark., four, six-inch thick concrete slabs were placed in forms directly on a graded dirt base completely covered with polyethylene sheeting. The slabs were finished with dual-pan, power rider trowels driving several types of specially designed float pans. Thermocouples were placed in the forms before the concrete was poured, and acoustic spectral analysis was conducted during the finishing process to aid in evaluating the performance of the pans as was done previously. A first set of pans was made of ceramic-impregnated UHMWPE and mounted beneath a steel disc of the same diameter. The ceramic-impregnated material was found to be more abrasion-resistant than unmodified UHMWPE materials. A second set of ceramic-impregnated UHMWPE pans used reduced-diameter steel backing (i.e., 15% of the diameter of the plastic pan). It was determined that an acceptable material should have an abrasion resistance of no greater than 150 (measured using ASTM Method G-65, with steel having a rating of 100; a lower rating has greater abrasion resistance.) Finally, normal steel pans that were spray-coated with polyurethane for abrasion-resistance were used.

TABLE 9

Impedance Matching Results

| Slab | Material | Diameter | F-Meter | Dimensions | Concrete |
|---|---|---|---|---|---|
| 1 | UHMWPE pans laminated beneath a steel disc | 36 Inch | Overall 50.1 Ff | 19'9" × 14'4" | Air Entrained, No Calcium |
| 2 | Steel pans with sprayed polyurethane coating | 46 Inch | Overall 55.6 Ff | 29'6" × 14'4" | Air Entrained, With Calcium |
| 3 | UHMWPE pans beneath small disc | 46 Inch | Overall 41.0 Ff | 19'9" × 14'4" | No Calcium |
| 4 | Steel pans with sprayed polyurethane coating | 46 Inch | Overall 48.4 Ff | 15'3" × 9'9" | No Calcium |

EXAMPLE 3

On Nov. 8, 2002, at Paragould, four, six-inch thick slabs were laid directly on a graded dirt base that was completely covered with polyethylene sheeting. The concrete was air entrained, with no calcium additives. The slabs were finished using dual-pan power rider trowels driving several types of specially designed float pans. Thermocouples were placed in the forms before the concrete was poured, and acoustic spectral analysis was conducted during the finishing process to aid in evaluating the performance of the pans, as was done previously. The first slab was finished with normal steel pans without modification, as a control. The second slab was finished with ceramic-impregnated UHMWPE pans mounted beneath a steel disc of the same diameter. The third slab was finished with normal steel pans that were spray-coated with a polyurethane compound that is extremely abrasion-resistant. A fourth slab was finished with ceramic-impregnated UHMWPE pans and mounted beneath a reduced-diameter steel backing disc (i.e., 15% of the diameter of the plastic pan), which used to support the curvature of the pan. The urethane-coated pans used for finishing the third slab failed quickly; the coating deteriorated and large segments of it very rapidly peeled off. After a brief delay, the same trowel used on the fourth slab finished the third slab.

TABLE 10

Delamination Characteristic of Finished Concrete

| Slab | Material | Diameter | Delamination |
|---|---|---|---|
| 1 | Steel Pans | 36 Inch | Apparent |
| 2 | Ceramic-impregnated UHMWPE pans | 46 Inch | Reduced |
| 3 | Steel pans with sprayed polyurethane coating followed by UHMWPE pans beneath small central steel disc | 46 Inch | Apparent |
| 4 | UHMWPE pans beneath smaller steel disc | 36 Inch | Reduced |

EXAMPLE 4

On Dec. 11, 2002, at Paragould, Ark., three six-inch thick concrete slabs were laid directly on a graded dirt base completely covered with polyethylene sheeting. The concrete was air-entrained, without calcium additives. The slabs were finished with dual-pan power rider trowels driving the three types of float pans as discussed in Example 3. Three pan designs were used. The pans were the same ones used in previous tests, to further study the abrasion resistance and durability of plastic pans. Observed results were as follows:

TABLE 11

Test Results for Impedance Matching Method

| Slab | Pan Material | Pan Diameter | F-Meter Overall |
|---|---|---|---|
| 1 | Steel | 46 inch | 79.5 Ff |
| 2 | Ceramic UHMWPE Compound | 46 inch | 45.9 Ff |
| 3 | UHMWPE W/No Backing | 46 inch | 50.9 Ff |

The first slab, which was finished with normal steel pans, exhibited extensive delamination. The third slab, which was finished with UHMWPE pans, had no observable delamination. We determined that the normal practice of power-troweling with materials having a significantly different acoustic impedance from that of fresh concrete contributes significantly to delamination. In other words, the use of pans made of steel (Z~46) upon low-slump fresh concrete (Z~2.7) results in a detrimental acoustic impedance mismatch. Another mismatch is obtained from the combination of high-slump concrete (Z~1.8) and ceramic-impregnated UHMWPE (Z~3.4). Pans of unmodified UHMWPE with an acoustic impedance of approximately 2.1 are closely matched in impedance to both low-slump and high-slump fresh concrete.

The data shown, typical of that taken in tests of acoustic impedance-matched concrete finishing equipment, shows clearly the advantages of our acoustic impedance matching apparatus and finishing methods.

From the foregoing, it will be seen that this invention is one well adapted to obtain all the ends and objects herein set forth, together with other advantages which are inherent to the illustrated structure and methods.

It will be understood that certain features and subcombinations are of utility and may be employed without reference to other features and subcombinations. This is contemplated by and is within the scope of the claims.

As many possible embodiments may be made of the invention without departing from the scope thereof. It is to be understood that all matter herein set forth or shown in the accompanying drawings is to be interpreted as illustrative and not in a limiting sense.

What is claimed is:

1. A screed comprising:

an elongated, rigid frame that traverses concrete to be finished, the frame comprising concrete contacting portions;

wherein the concrete contacting portions comprise acoustic matching material;

wherein said acoustic matching material is fabricated from a material that has an acoustic impedance within 67% to 150% of the acoustic impedance of the concrete being finished; and, wherein said acoustic matching material has an abrasion resistance of no greater than 150 measured using ASTM Method G-65 where steel is given a rating of 100.

2. The machine as defined in claim 1 wherein the acoustic matching material comprises ultra-high molecular weight polyethylene (UHMWPE) plastic.

3. A triangular truss screed comprising:

a rigid frame adapted to be moved over plastic concrete;

means supported by the frame for distributing plastic concrete;

means for vibrating the frame to remove entrained air and promote consolidation;

at least one concrete contacting portion vibrated by said vibrating means, said contacting portion comprising acoustic matching material, said material characterized by an acoustic impedance approximating the acoustic impedance of said plastic concrete;

wherein said acoustic matching material is fabricated from a material that has an acoustic impedance within 67% to 150% of the acoustic impedance of the fresh concrete being placed;

wherein said acoustic matching material has an abrasion resistance of no greater than 150 measured using ASTM Method G-65 where steel is given a rating of 100; and, whereby outputted acoustic energy is optimally transferred to the plastic concrete.

4. The triangular truss screed as defined in claim 3 wherein said acoustic matching material is made from ultra-high molecular weight polyethylene (UHMWPE) plastic.

5. A telescoping boom screed comprising:

a rigid frame adapted to be moved over plastic concrete;

an auger supported by the frame for distributing plastic concrete;

means for vibrating the frame to remove entrained air and promote consolidation;

at least one concrete contacting portion comprising acoustic matching material, said material characterized by an acoustic impedance approximating the acoustic impedance of said plastic concrete;

wherein said acoustic matching material is fabricated from a material that has an acoustic impedance within 67% to 150% of the acoustic impedance of the fresh concrete being placed;

wherein said acoustic matching material has an abrasion resistance of no greater than 150 measured using ASTM Method G-65 where steel is given a rating of 100; and, whereby outputted acoustic energy is optimally transferred to the plastic concrete.

6. The telescoping boom screed as defined in claim 5 wherein said acoustic matching material is made from ultra-high molecular weight polyethylene (UHMWPE) plastic.

* * * * *